US011457749B2

(12) United States Patent
Pena et al.

(10) Patent No.: US 11,457,749 B2
(45) Date of Patent: Oct. 4, 2022

(54) PRODUCT DISPLAY SYSTEM HAVING ENHANCED CAPABILITIES AND ASSOCIATED PRODUCT DISPLAY PUSHER SYSTEM

(71) Applicant: TracFone Wireless, Inc., Miami, FL (US)

(72) Inventors: Elvis Pena, Miami, FL (US); Audra Gabbard, Miami, FL (US); Shelby Harrison, Miami, FL (US)

(73) Assignee: Tracfone Wireless, Inc., Miami, FL (US)

( * ) Notice: Subject to any disclaimer, the term of this patent is extended or adjusted under 35 U.S.C. 154(b) by 0 days.

(21) Appl. No.: 17/335,240

(22) Filed: Jun. 1, 2021

(65) Prior Publication Data

US 2021/0369006 A1 Dec. 2, 2021

Related U.S. Application Data

(60) Provisional application No. 63/031,847, filed on May 29, 2020.

(51) Int. Cl.

| | |
|---|---|
| ***A47F 3/00*** | (2006.01) |
| ***A47F 1/12*** | (2006.01) |
| ***A47F 5/00*** | (2006.01) |

(52) U.S. Cl.

CPC ..... *A47F 3/002* (2013.01); *A47F 1/126* (2013.01); *A47F 3/005* (2013.01); *A47F 2005/0075* (2013.01)

(58) Field of Classification Search

CPC ..... A47F 3/002; A47F 1/126; A47F 3/005; A47F 2005/0075; A47F 1/125; A47F 5/0018; A47F 1/04; A47F 1/12; A47F 3/02; A47F 3/08; A47F 3/063; A47F 3/00; A47F 3/125; A47B 88/975; A47B 2088/976; A47B 63/00

USPC ..... 211/59.3; 312/348.3, 35, 193, 190, 114, 312/124, 138.1, 139.2

See application file for complete search history.

(56) References Cited

U.S. PATENT DOCUMENTS

| | | | | | |
|---|---|---|---|---|---|
| 981,486 | A * | 1/1911 | Shaner | A47F 3/043 | 49/453 |
| 1,516,404 | A * | 11/1924 | Raymond | A47F 3/005 | 312/139.1 |
| 2,047,937 | A * | 7/1936 | Bohn | A47F 3/043 | 49/453 |
| 2,824,666 | A * | 2/1958 | Hausladen | G07F 11/40 | 221/232 |
| 3,104,137 | A * | 9/1963 | Samuell | A47F 1/126 | 312/71 |
| 3,601,462 | A * | 8/1971 | Fenwick | E06B 3/4663 | 312/139.2 |
| 3,628,289 | A * | 12/1971 | Buffington | F25D 23/021 | 49/409 |

(Continued)

*Primary Examiner* — Jennifer E. Novosad

(57) ABSTRACT

A retail product display system configured to display product in a retail setting that includes a generally open front side; a plurality of shelf units extending across the generally open front side; at least one door configured to provide security; and a pusher tray assembly configured to hold products. The pusher tray assembly includes a pusher tray including a floor, a bottom surface, a front wall, at least one sidewall, and at least one back wall, where the floor is configured to hold the products thereon.

29 Claims, 28 Drawing Sheets

(56) References Cited

U.S. PATENT DOCUMENTS 3,736,035 A * 5/1973 Brown ..... A47B 97/001 312/107
4,070,074 A * 1/1978 Rohme ..... E05D 3/022 109/70
4,148,535 A * 4/1979 Fenwick ..... A47B 47/04 16/95 R
4,250,955 A * 2/1981 Plattner ..... A47F 3/0408 165/244
4,591,214 A * 5/1986 Reuter ..... E05D 15/582 312/110
4,706,821 A * 11/1987 Kohls ..... A47F 1/126 211/59.3
4,887,737 A * 12/1989 Adenau ..... A47F 1/126 221/3
5,240,125 A * 8/1993 Kunz ..... A47F 1/126 211/59.3
5,269,597 A * 12/1993 Yenglin ..... A47F 3/02 312/138.1
5,366,099 A * 11/1994 Schmid ..... A47F 1/126 211/175
5,399,010 A * 3/1995 McClung ..... E06B 3/5045 312/322
5,553,934 A * 9/1996 Wells ..... A47F 3/001 312/128
5,605,237 A * 2/1997 Richardson ..... A47F 1/126 211/51
5,657,880 A * 8/1997 Birnbaum ..... B42F 7/12 211/11
5,665,304 A * 9/1997 Heinen ..... A47F 1/126 108/110
5,819,982 A * 10/1998 Brown ..... A47F 1/126 221/226
5,855,281 A * 1/1999 Rabas ..... A47F 1/126 211/59.3
5,855,283 A * 1/1999 Johnson ..... A47F 1/126 211/59.3
5,878,895 A * 3/1999 Springs ..... A47F 1/126 211/59.3
5,918,954 A * 7/1999 Papadakis ..... A47F 3/005 312/126
5,992,653 A * 11/1999 Anderson ..... A47F 1/125 211/59.3
6,076,670 A * 6/2000 Yeranossian ..... A47F 1/126 206/362
6,193,085 B1 * 2/2001 Nook ..... A47F 1/126 211/187
6,752,277 B1 * 6/2004 Sempliner ..... A47F 1/126 211/1.57
7,303,095 B2 * 12/2007 Nagelski ..... A47F 1/087 221/256
7,451,881 B2 * 11/2008 Hardy ..... A47F 1/125 211/175
7,641,072 B1 * 1/2010 Vlastakis ..... A47F 3/002 221/123
7,661,545 B2 * 2/2010 Hardy ..... G08B 13/08 211/189
7,828,158 B2 * 11/2010 Colelli ..... A47F 1/126 211/59.3
8,047,385 B2 * 11/2011 Hardy ..... A47F 1/12 211/59.3
8,485,391 B2 * 7/2013 Vlastakis ..... A47F 3/002 221/15
8,622,227 B2 * 1/2014 Bird ..... A47F 5/0861 211/119.003
8,657,154 B2 * 2/2014 Obitts ..... G07F 11/005 221/124
8,925,745 B2 * 1/2015 Theisen ..... A47B 96/021 211/59.3
9,240,090 B2 * 1/2016 Vogler ..... G07F 11/42
9,254,049 B2 * 2/2016 Nagel ..... A47F 1/04
9,364,101 B1 * 6/2016 Anderson ..... A47F 3/007
9,565,952 B1 * 2/2017 Luberto ..... A47F 1/04
10,206,521 B2 * 2/2019 Murphy ..... A47F 1/126
11,147,394 B2 * 10/2021 Vogler ..... A47F 5/0025
2004/0060944 A1 * 4/2004 Gervasi ..... G08B 3/02 221/263
2005/0072747 A1 * 4/2005 Roslof ..... A47F 1/126 211/59.3
2005/0189369 A1 * 9/2005 Vlastakis ..... A47F 3/002 221/123
2006/0180603 A1 * 8/2006 Eckert ..... G07F 11/16 221/279
2008/0257842 A1 * 10/2008 Mason ..... A47F 1/126 211/133.6
2008/0283477 A1 * 11/2008 Wamsley ..... A47F 1/04 211/4
2009/0039040 A1 * 2/2009 Johnson ..... A47F 5/0025 211/120
2009/0184130 A1 * 7/2009 Miller ..... A47F 1/126 221/279
2009/0242582 A1 * 10/2009 Vlastakis ..... G07F 11/62 221/123
2010/0032392 A1 * 2/2010 Camello ..... A47F 7/28 211/59.3
2010/0059469 A1 * 3/2010 Mason ..... A47F 1/126 211/162
2010/0072150 A1 * 3/2010 Takashima ..... A47F 5/0846 211/59.3
2010/0219728 A1 * 9/2010 Wolpow ..... A47F 5/0025 312/326
2011/0042331 A1 * 2/2011 Johnson ..... A47B 96/02 211/49.1
2011/0049067 A1 * 3/2011 Garson ..... A47F 1/126 211/59.3
2011/0087369 A1 * 4/2011 Bauer ..... G07F 17/18 700/232
2011/0100941 A1 * 5/2011 Luberto ..... A47F 1/126 211/134
2011/0220597 A1 * 9/2011 Sherretts ..... A47F 1/128 211/59.3
2012/0266437 A1 * 10/2012 Camello ..... A47F 7/28 29/428
2013/0193156 A1 * 8/2013 Kaleta ..... A47F 3/002 221/7
2013/0264917 A1 * 10/2013 Baptiste ..... A47F 3/002 312/221
2013/0341292 A1 * 12/2013 Johnson ..... A47F 1/126 211/1.57
2014/0061218 A1 * 3/2014 Vogler ..... G07F 11/38 221/1
2014/0190913 A1 * 7/2014 Hardy ..... G06Q 10/087 211/59.3
2014/0250749 A1 * 9/2014 Theisen ..... A47B 96/027 40/649
2014/0305891 A1 * 10/2014 Vogler ..... A47F 5/0846 211/59.3
2015/0083744 A1 * 3/2015 Vogler ..... A47F 1/126 221/154
2015/0096997 A1 * 4/2015 Obitts ..... A47F 1/125 221/1
2015/0108074 A1 * 4/2015 Pichel ..... A47F 1/126 211/59.3
2015/0321827 A1 * 11/2015 Lockwood ..... A47F 3/002 221/265
2017/0224131 A1 * 8/2017 Murphy ..... A47F 3/002
2018/0310725 A1 * 11/2018 Pena ..... A47F 5/005
2019/0125101 A1 * 5/2019 Pozzi ..... A47B 57/58
2019/0159609 A1 * 5/2019 Kalm ..... A47F 5/0062
2021/0227996 A1 * 7/2021 Kerr ..... A47F 5/005
2021/0369006 A1 * 12/2021 Pena ..... A47F 3/005

* cited by examiner

PRODUCT DISPLAY SYSTEM HAVING ENHANCED CAPABILITIES AND ASSOCIATED PRODUCT DISPLAY PUSHER SYSTEM

CROSS-REFERENCE TO RELATED APPLICATIONS

This application claims the benefit of U.S. Provisional Application No. 63/031,847 filed May 29, 2020, which is hereby incorporated by reference in its entirety for all purposes as if fully set forth herein.

FIELD OF THE DISCLOSURE

The disclosure relates to a product display system having enhanced capabilities. Moreover, the disclosure relates to a product display system having enhanced display capabilities. Additionally, the disclosure relates to a product display system having enhanced security capabilities. The disclosure relates to a product display system and associated product display pusher system having enhanced capabilities. Moreover, the disclosure relates to a product display system and associated product display pusher system having enhanced display capabilities. Additionally, the disclosure relates to a product display system and associated product display pusher system having enhanced security capabilities.

BACKGROUND OF THE DISCLOSURE

A number of product displays currently exist. However, operation of these current product displays is deficient in a number of different ways. In this regard, security configurations of the product displays are not easily changeable. Accordingly, an amount of security provided by the product display cannot be easily increased or decreased as needed. Moreover, the prior art displays are typically constructed such that products are not positioned and/or moved effectively, and the performance of the display is lacking. For example, product is not always well positioned by such product displays and restocking is often cumbersome. Moreover, access to the product, interaction with the display, and removing product from the display can be difficult.

Accordingly, a product display system that addresses the prior art deficiencies including configurable security features, improved product positioning and display, improved restocking, improved product holding and dispensing, and/or as well as other deficiencies is needed.

SUMMARY OF THE DISCLOSURE

The foregoing needs are met, to a great extent, by the disclosure, wherein in one aspect a technique and apparatus are provided for a product display system having enhanced capabilities, enhanced display capabilities, and/or enhanced security capabilities.

One aspect includes a retail product display system configured to display product in a retail setting, the retail product display system includes a top surface, at least one side surface, a back surface, and a bottom surface configured to form a generally rectangular box structure that includes a generally open front side; a plurality of shelf units extending across the generally open front side; a pusher tray assembly configured to hold products that includes a pusher tray including a floor, a bottom surface, a front wall, at least one sidewall, and at least one back wall, where the floor is configured to hold the products thereon; at least one door configured to provide security for the product that is held within the generally open front side; a doorframe configured to hold the at least one door; where one or more of the top surface, the side surface, the back surface, and the bottom surface connect with a connection; and where the connection includes at least one of the following: a welded portion, a mechanically fastened portion, a brazed portion, a bent portion, and an adhesive connection portion.

One aspect includes a retail product display system configured to display product in a retail setting, the retail product display system includes a top surface, at least one side surface, a back surface, and a bottom surface configured to form a generally rectangular box structure that includes a generally open front side; a plurality of shelf units extending across the generally open front side; a pusher tray assembly configured to hold products includes a pusher tray including a floor, a bottom surface, a front wall, at least one sidewall, and at least one back wall, where the floor is configured to hold the products thereon; at least one door configured to provide security for the product that is held within the generally open front side; a doorframe configured to hold the at least one door; where one or more of the top surface, the side surface, the back surface, and the bottom surface connect with a connection; where the connection includes at least one of the following: a welded portion, a mechanically fastened portion, a brazed portion, a bent portion, and an adhesive connection portion; and where the doorframe is configured to securely hold the doors with a track to guide the doors with a lateral motion.

One aspect includes a retail product display system configured to display product in a retail setting, the retail product display system includes a top surface, at least one side surface, a back surface, and a bottom surface configured to form a generally rectangular box structure that includes a generally open front side; a plurality of shelf units extending across the generally open front side; a pusher tray assembly configured to hold products includes a pusher tray including a floor, a bottom surface, a front wall, at least one sidewall, and at least one back wall, where the floor is configured to hold the products thereon; at least one door configured to provide security for the product that is held within the generally open front side; a doorframe configured to hold the at least one door; where the pusher tray assembly further includes a pusher paddle having a front face and a back face and an engagement mechanism arranged on a lower side of the pusher paddle and configured to secure the pusher paddle to the floor; where one or more of the top surface, the side surface, the back surface, and the bottom surface connect with a connection; and where the connection includes at least one of the following: a welded portion, a mechanically fastened portion, a brazed portion, a bent portion, and an adhesive connection portion.

There has thus been outlined, rather broadly, certain aspects of the disclosure in order that the detailed description thereof herein may be better understood, and in order that the present contribution to the art may be better appreciated. There are, of course, additional aspects of the disclosure that will be described below and which will form the subject matter of the claims appended hereto.

In this respect, before explaining at least one aspect of the disclosure in detail, it is to be understood that the disclosure is not limited in its application to the details of construction and to the arrangements of the components set forth in the following description or illustrated in the drawings. The disclosure is capable of aspects in addition to those described and of being practiced and carried out in various ways. Also, it is to be understood that the phraseology and terminology employed herein, as well as the abstract, are for the purpose of description and should not be regarded as limiting.

As such, those skilled in the art will appreciate that the conception upon which this disclosure is based may readily be utilized as a basis for the designing of other structures, methods, and systems for carrying out the several purposes of the disclosure. It is important, therefore, that the claims be regarded as including such equivalent constructions insofar as they do not depart from the spirit and scope of the disclosure.

DETAILED DESCRIPTION

Figure 1:
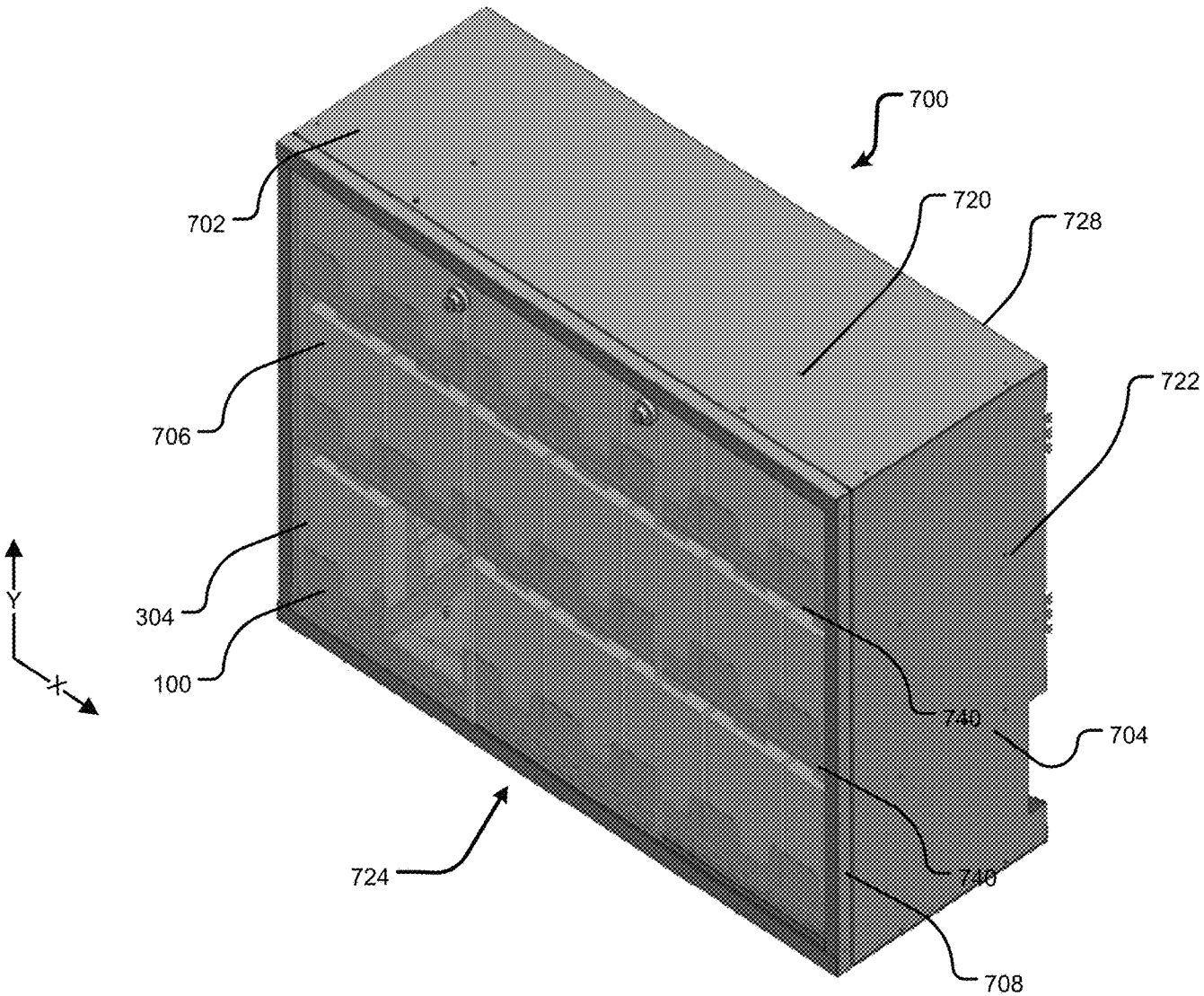
FIG. 1 illustrates a front right perspective view of a retail product display system according to aspects of the disclosure.

The disclosure will now be described with reference to the drawing figures, in which like reference numerals refer to like parts throughout. Aspects of the disclosure advantageously provide a product display pusher system.

As will be described in greater detail herein, the disclosure is directed to a custom molded pusher system that holds or otherwise maintains product, such cards, Service Plan cards, and/or the like, pushed towards the front at all times. The pusher system may include a tray. The tray can be easily removed from the display in order to restock (pull the "pusher paddle" back to add more cards). The pusher system may include a front "Inventory Control Bar" that retains the stack of cards together as you pull the front card—Avoiding "Spillage" of cards. Additionally, the Inventory Control Bar has a finger relief to make it easier for the first card to be pulled with ease. The pusher system may further include a front "Graphic Holder" that allows for special promotional signs or plan update information to be clearly shown on the front of each card pusher tray. Additionally, the pusher system may include a price channel that allows for the store to place the pricing signage on the front of each tray for easy visibility.

FIG. 1 illustrates a front right perspective view of a retail product display system according to aspects of the disclosure.

Figure 2:
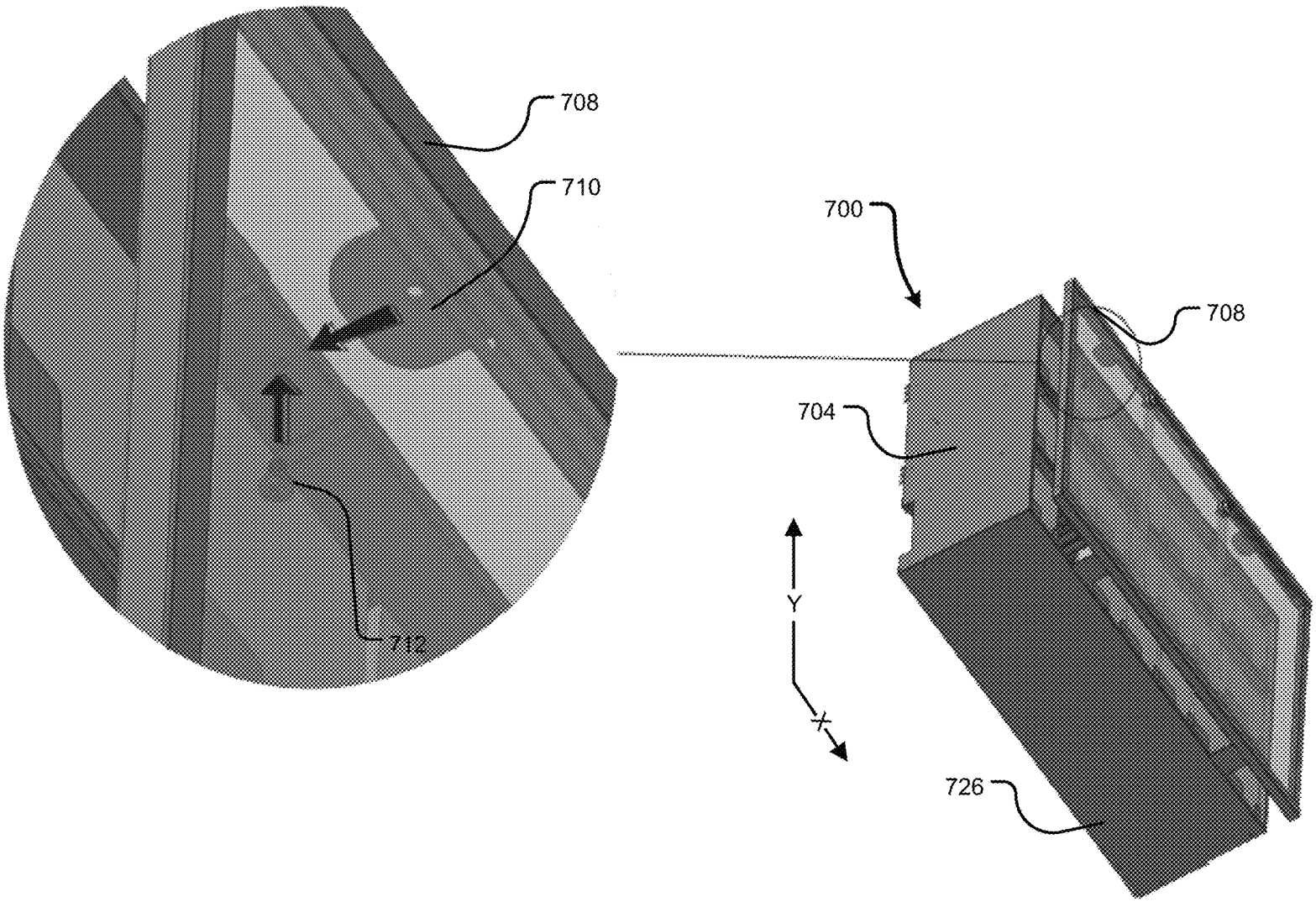
FIG. 2 illustrates a bottom left perspective view of the retail product display system according to FIG. 1.

FIG. 2 illustrates a bottom left perspective view of the retail product display system according to FIG. 1.

Figure 3:
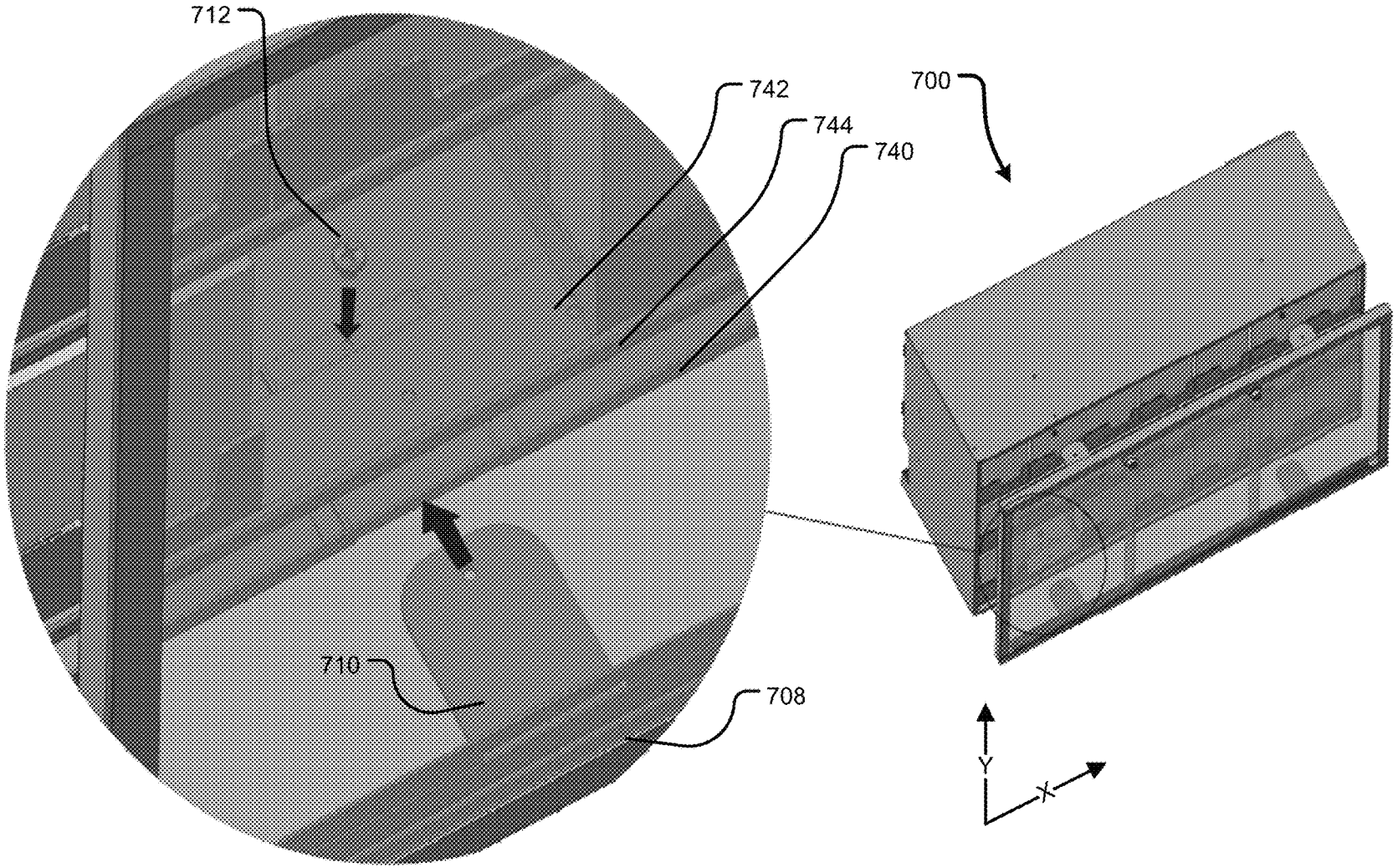
FIG. 3 illustrates a top left perspective view of the retail product display system according to FIG. 1.

FIG. 3 illustrates a top left perspective view of the retail product display system according to FIG. 1.

Figure 4:
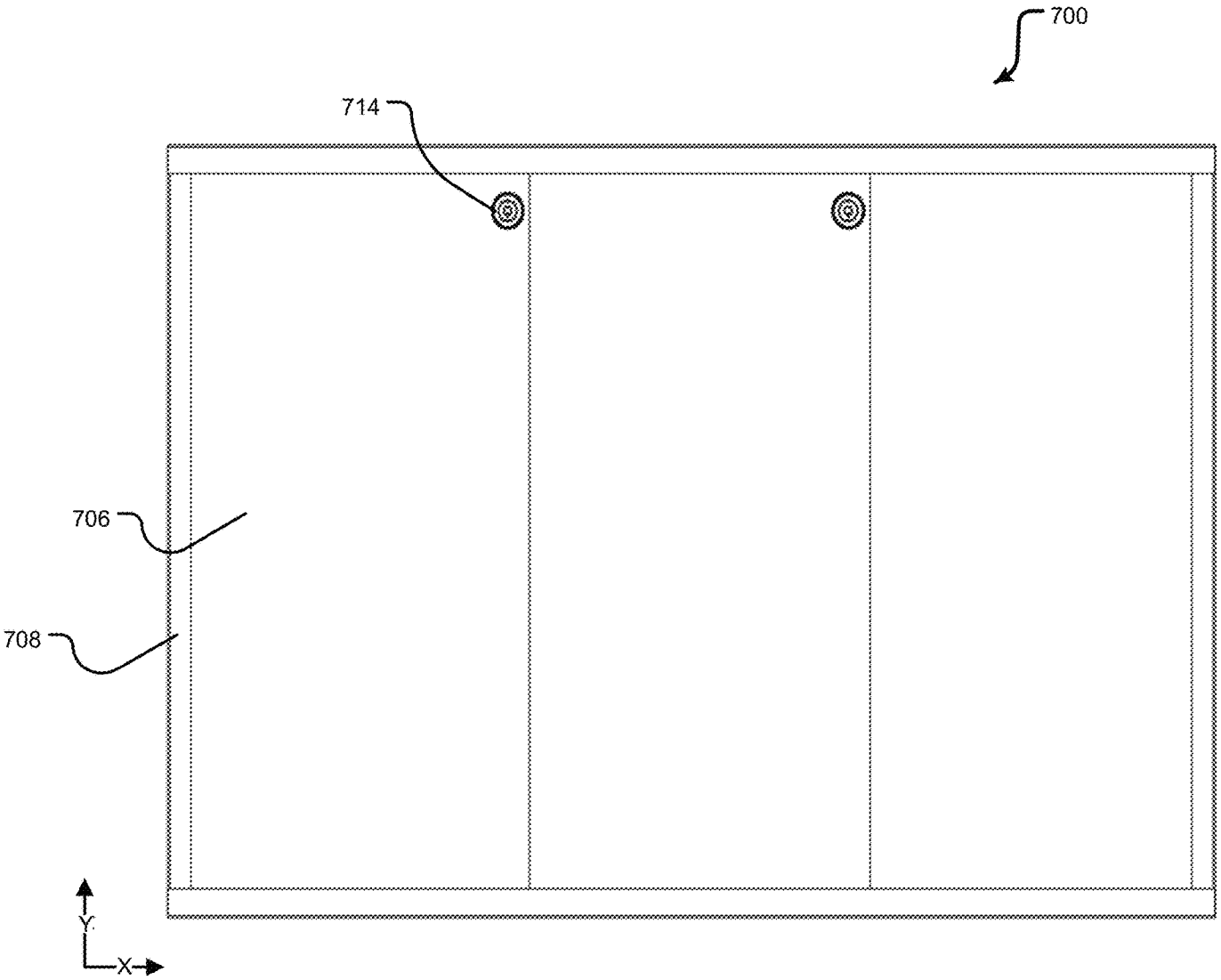
FIG. 4 illustrates a front view of a portion of the retail product display system according to FIG. 1.

FIG. 4 illustrates a front view of a portion of the retail product display system according to FIG. 1.

Figure 5:
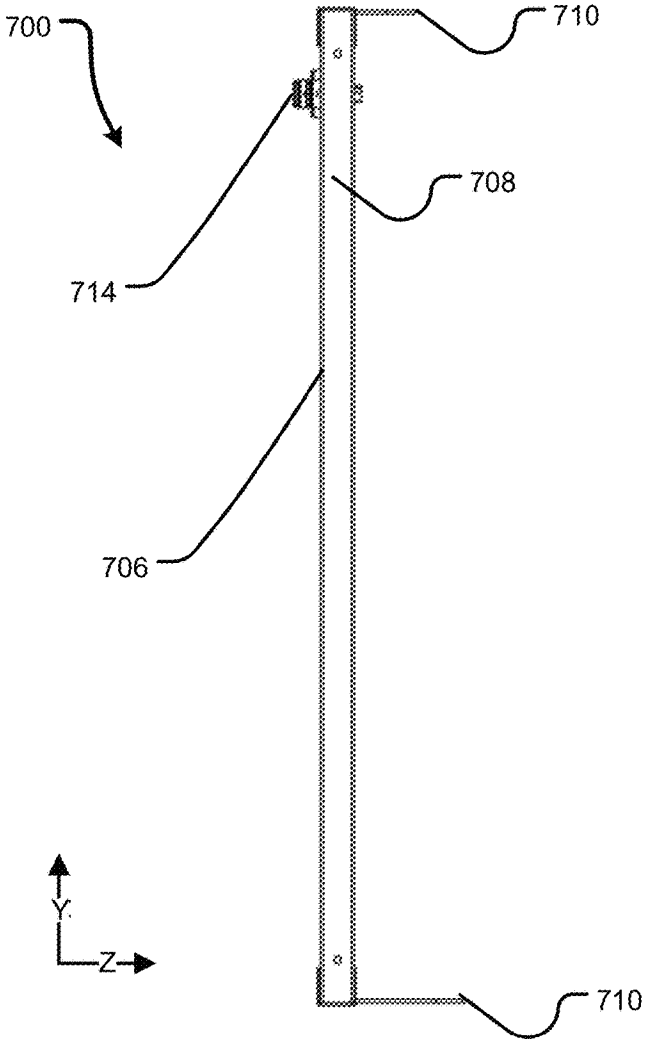
FIG. 5 illustrates a side view of a portion of the retail product display system according to FIG. 1.

FIG. 5 illustrates a side view of a portion of the retail product display system according to FIG. 1.

Figure 6:
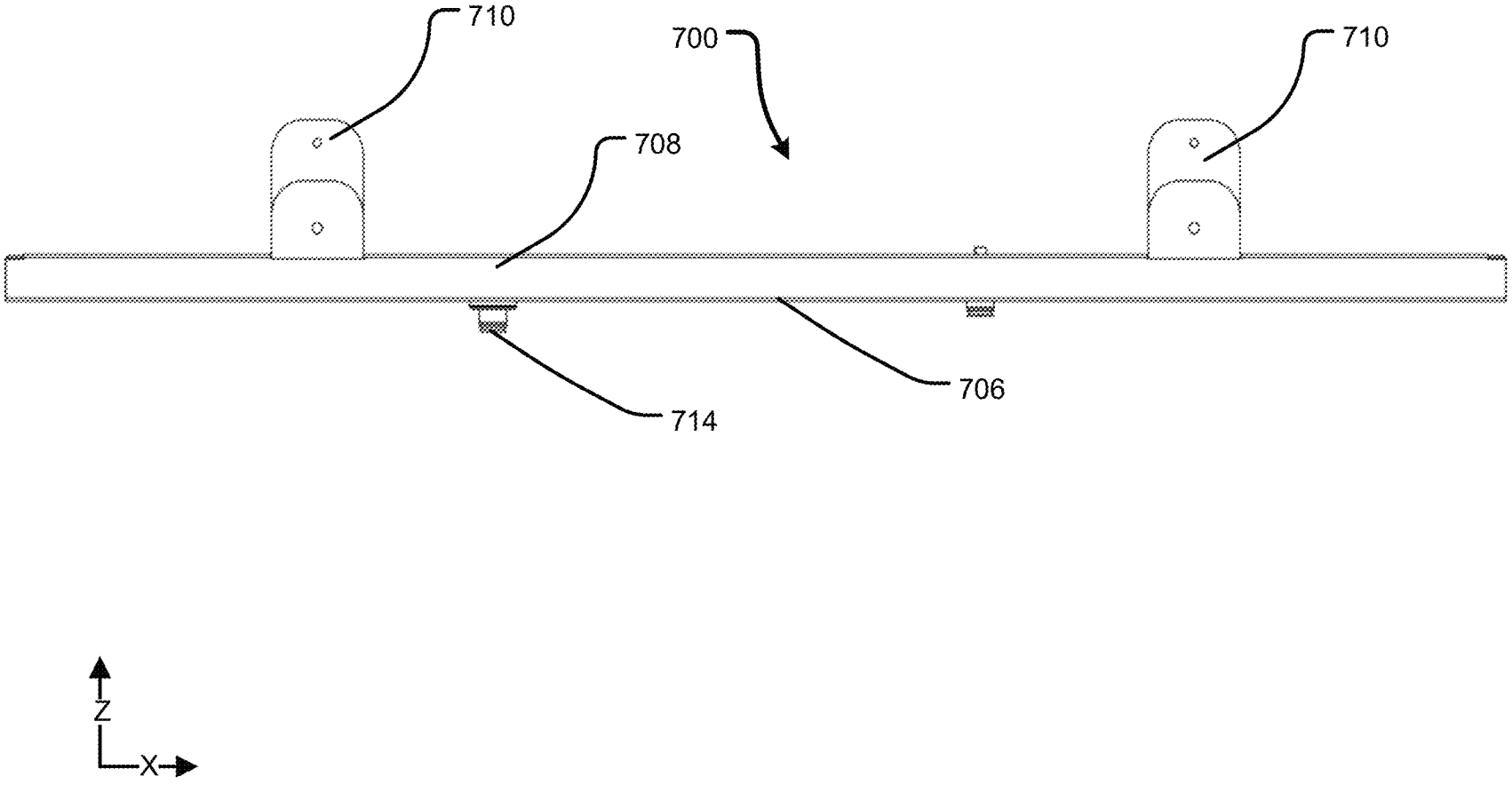
FIG. 6 illustrates a top view of a portion of the retail product display system according to FIG. 1.

FIG. 6 illustrates a top view of a portion of the retail product display system according to FIG. 1.

Figure 7:
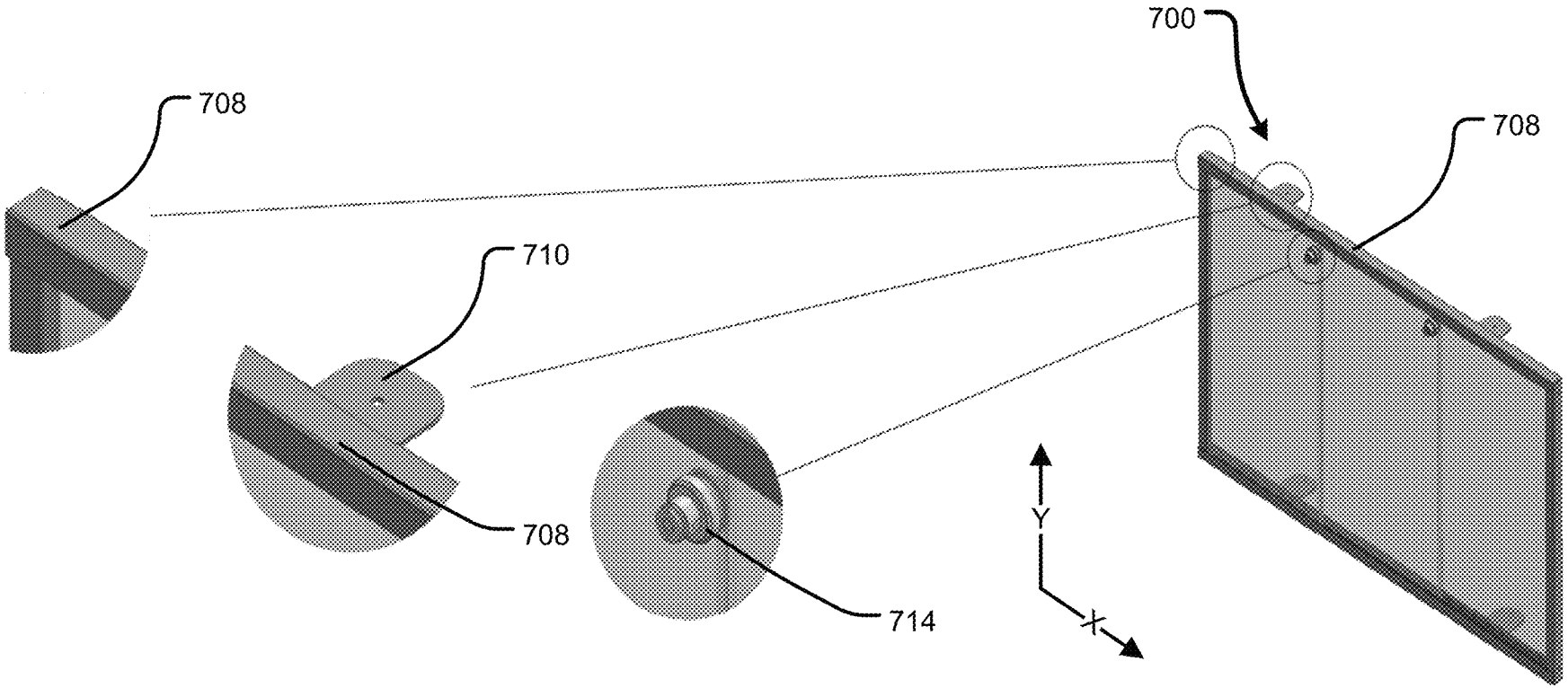
FIG. 7 illustrates a partial front right perspective view of the retail product display system according to FIG. 1.

FIG. 7 illustrates a partial front right perspective view of the retail product display system according to FIG. 1.

Figure 8:
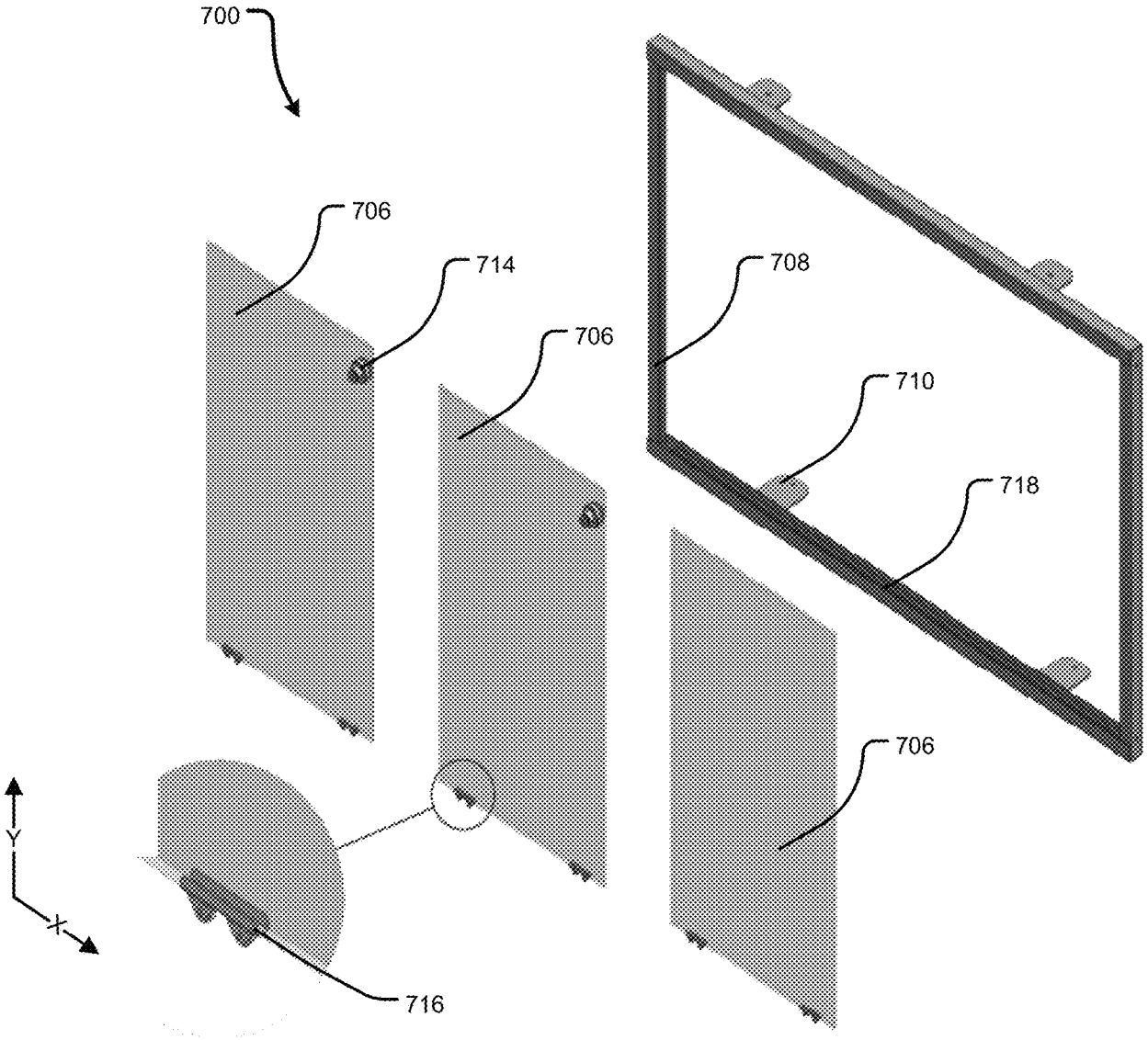
FIG. 8 illustrates a partial exploded front right perspective view of the retail product display system according to FIG. 1.

FIG. 8 illustrates a partial exploded front right perspective view of the retail product display system according to FIG. 1.

In particular, FIG. 1 illustrates a retail product display system 700 that may be used for displaying product in a retail setting. In particular, the retail product display system 700 may be configured and implemented to utilize product holders. For example, the retail product display system 700 may be used in conjunction with a pusher tray assembly 100 disclosed herein. However, the retail product display system 700 may be implemented with other types of products and/or other types of product holders.

The retail product display system 700 may include a top surface 702, a side surface 704, doors 706, a doorframe 708, at least one tab 710, at least one fastener 712, at least one doorlock 714, roller bearings 716, a track 718, and/or the like. Moreover, the pusher tray assembly 100 described herein may be configured and/or utilized to operate in conjunction with other types of retail fixtures.

The retail product display system 700 may be implemented as a generally rectangular box structure that includes the top surface 702, the side surface 704, a back surface 728 (not shown), and a bottom surface 726 (see FIG. 2). Moreover, the construction of the retail product display system 700 may form a generally open front side 724 that is closed off by the doors 706. In one aspect, one or more of the top surface 702, the side surface 704, the back surface 728, and the bottom surface 726 may be formed of panels. The panels may include a sheet metal such as steel, aluminum, and/or the like. In one aspect, the panels may include painted steel.

In one aspect, one or more of the top surface 702, the side surface 704, the back surface 728, and the bottom surface 726 may connect at corners or edge portions. For example, the top surface 702 may connect to the side surface 704 and the top surface 702 may connect to the back surface 728; the back surface 728 may connect to the bottom surface 726 and the back surface 728 may connect to the side surface 704; and the side surface 704 may connect to the bottom surface 726. The connections between each may include welded portions, mechanically fastened portions, brazed portions, bent portions, adhesive connection portions, and/or the like.

The retail product display system 700 may be formed of any type of rugged and rigid material providing security for the product 302 that is held within the pusher tray assembly 100 or any other type of product. Moreover, the retail product display system 700 may be formed of any type of rugged and rigid material allowing for stackable arrangements of a plurality of retail fixtures as described in further detail herein. The material for the retail product display system 700 may include metals, sheet metal, synthetic, plastic, bioplastic, polymer, plastic composite, and/or the like. In one aspect, the material of the retail product display system 700 may include a sheet metal such as steel, aluminum, and/or the like. In one aspect, the material of the retail product display system 700 may include painted steel.

The retail product display system 700 may be further configured to be stackable and/or the retail product display system 700 may be further configured to be arranged adjacent another retail fixture. The another retail fixture may be another implementation of the retail product display system 700 as disclosed. Alternatively, the another fixture may be another type of retail fixture. In this regard, the top surface 702 may include one or more apertures 720 for receiving a fastener for connection to a bottom side of another retail fixture positioned above the top surface 702. In a similar manner, the side surface 704 may include one or more apertures 722 for receiving a fastener, alignment pin, and/or the like for connection and/or alignment to a side of another retail fixture positioned adjacent the side surface 704 of the retail product display system 700. Any number of apertures may be arranged with the retail product display system 700 and moreover the apertures may be located anywhere with respect to the retail product display system 700. Additionally, other types of fastening or connection mechanisms may be utilized for stacked configurations and/or adjacent configurations of the retail product display system 700.

In further aspects, the retail product display system 700 may be configured to have legs that extend from the bottom surface 726. In particular, the retail product display system 700 may implement legs to raise an elevation of the retail product display system 700 to allow for the product to be at a higher elevation for retail purposes.

As noted above, the retail product display system 700 may be structured, configured, and arranged with the open front side 724. In this regard, the open front side 724 may be implemented with a lower security configuration without any structure impeding access to the product held by the retail product display system 700. Alternatively, the open front side 724 may be implemented with a higher security configuration with structure impeding access to the product held by the retail product display system 700. In one aspect, the retail product display system 700 may be implemented with the open front side 724 with a higher security configuration such that the open front side 724 is closed off by the doors 706.

In one aspect, the higher security configuration may be implemented such that the open front side 724 may be generally surrounded by the doorframe 708. The doorframe 708 may be implemented as a metal frame, a steel frame, a layered steel frame, and/or the like. In one aspect, the doorframe 708 may include a plurality of structural portions having a rectangular cross-section, square cross-section, or the like. The structural portions may be hollow, the structural portions may be metallic, the structural portions may be painted, coated, powder coated, and/or the like. The structural portions of the doorframe 708 may be connected to form a rectangular frame, square frame, a polygonal frame, and/or the like is generally illustrated in FIG. 8. The structural portions of the doorframe 708 may be connected with mechanical fasteners, welding, and/or the like.

When a lower security configuration is desired, the doorframe 708 may be quickly and easily removed from the retail product display system 700. On the other hand, when a higher security configuration is desired, the doorframe 708 may be quickly and easily installed into the retail product display system 700. Accordingly, the security configuration of the retail product display system 700 may be easily and quickly changed as needed by the retail setting.

As illustrated in, for example, FIG. 1, the retail product display system 700 further includes a plurality of shelf units 740 extending between the side walls of the retail product display system 700. Moreover, the retail product display system 700 may be configured as shown to hold a plurality of the pusher tray assembly 100. In this regard and with reference to FIG. 3, the shelf units 740 may extend across the open front side 724 with an upper surface 742 parallel to the x-axis. Additionally, an edge structure 744 may be arranged on the upper surface 742. The edge structure 744 may configured to engage a portion of the pusher tray assembly 100 in order to hold the pusher tray assembly 100 securely on the shelf units 740 of the retail product display system 700.

With further reference to FIG. 3, it is noted that the pusher tray assembly 100 has been removed from the upper surface 742 of the shelf units 740 in order to access the 712 to allow insertion of mechanical fastening of the at least one tab 710 into the retail product display system 700 for attachment of the doorframe 708.

The retail product display system 700 may further include the doors 706 to provide additional security for the product that is held within the retail product display system 700 such as the product 302 held by the pusher tray assembly 100. The doors 706 may be formed of any type of material. The material of the doors 706 may include glass, synthetic materials, and/or the like. In one aspect, the doors 706 may be made of a transparent material in order for customers to see the first one of the product 304 arranged within the retail product display system 700.

FIG. 2 and FIG. 3 each include a detail illustration of particular details and components of the retail fixture 700. With reference to FIG. 2 and FIG. 3, the retail product display system 700 may be configured to include the doorframe 708 with the at least one tab 710. In particular, the at least one tab 710 may include a plurality of tabs attached to the doorframe 708. The at least one tab 710 may be configured to securely attach the doorframe 708 to the retail product display system 700. In particular, one of the at least one tab 710 may attach the doorframe 708 to the top surface 702; and another one of the at least one tab 710 may attach the doorframe 708 to the bottom side of the retail product display system 700.

The at least one tab 710 may include a heavy gauge material such as a metal. The at least one tab 710 may include an aperture for receiving the at least one fastener 712. More specifically, the at least one tab 710 may extend from the doorframe 708 and the doorframe 708 may be arranged to extend into a corresponding slot in the retail product display system 700. The at least one fastener 712 may extend through a corresponding hole into the slot of the retail product display system 700 and extend through the at least one tab 710 in order to securely hold the doorframe 708 to the retail product display system 700. As illustrated in FIG. 2, the at least one tab 710 is extending into the top surface 702 of the retail product display system 700. In a similar fashion, as illustrated in FIG. 3, the at least one tab 710 is extending into the bottom side of the retail product display system 700.

FIG. 8 includes a detail illustration of particular details and components of the retail fixture 700. With reference to FIG. 8, the retail product display system 700 may include a plurality of the doors 706. In one aspect, the retail product display system 700 may include three of the doors 706. However, any number of the doors 706 may be utilized. The doorframe 708 may be configured to securely hold the doors 706. In particular, the doorframe 708 may include a construction for holding the doors 706 for sliding or lateral movement along the x-axis as shown in FIG. 8. In one aspect, the doorframe 708 may include the track 718. The track 718 may be configured to support the doors 706 as well as guide the doors 706 with lateral motion along the x-axis. In this regard, the doors 706 may include one or more of the roller bearings 716 arranged at a lower edge of the doors 706. The roller bearings 716 may be received in the track 718 to provide a smooth lateral motion as described herein.

FIG. 7 includes a detail illustration of particular details and components of the retail fixture 700. With reference to FIG. 7, the retail fixture 700 may implement the doorframe 708 such that it may be configured such that a plurality of the track 718 may be implemented in parallel. In this regard, there may be a plurality of the doors 706 and a plurality of the track 718 such that each implementation of the doors 706 includes its own implementation of the track 718. In this regard, one of the doors 706 may open to a position that is arranged behind another one of the doors 706, which provides ease of access to the retail fixture. However, in other configurations, one or more of the doors 706 may share a common implementation of the track 718.

The doors 706 may further include at least one doorlock 714. The at least one doorlock 714, may extend through an aperture arranged in the doors 706. The at least one doorlock 714 may be configured to prevent an adjacent one of the doors 706 from sliding past one another. The at least one doorlock 714 may include a keyhole mechanism configured to receive a key for placing the at least one doorlock 714 in a locked configuration and alternatively placing the at least one doorlock 714 in an unlocked configuration.

Figure 9:
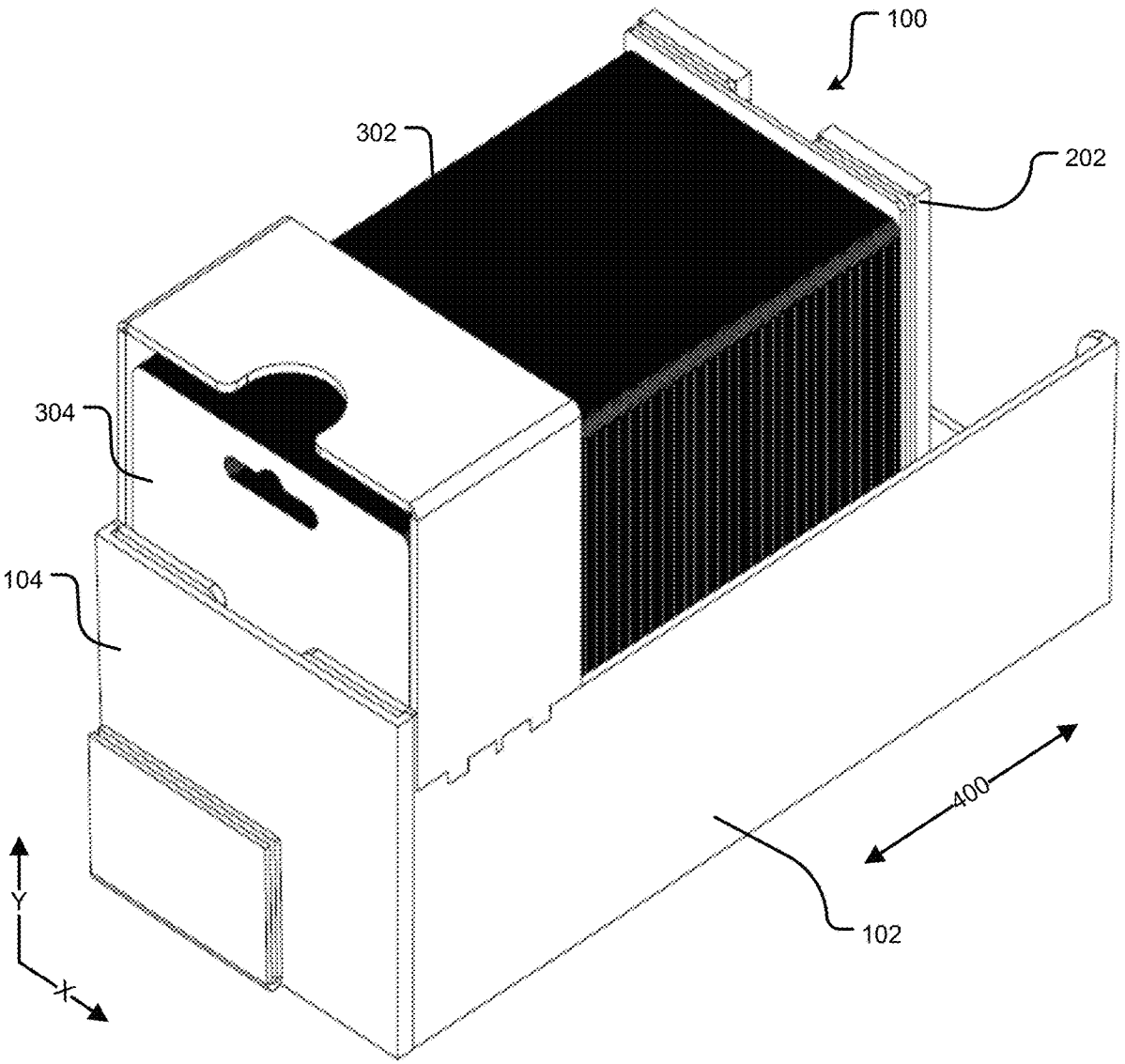
FIG. 9 illustrates a front right perspective view of a product display pusher system according to aspects of the disclosure.

FIG. 9 illustrates a front right perspective view of a product display pusher system according to aspects of the disclosure.

Figure 10:
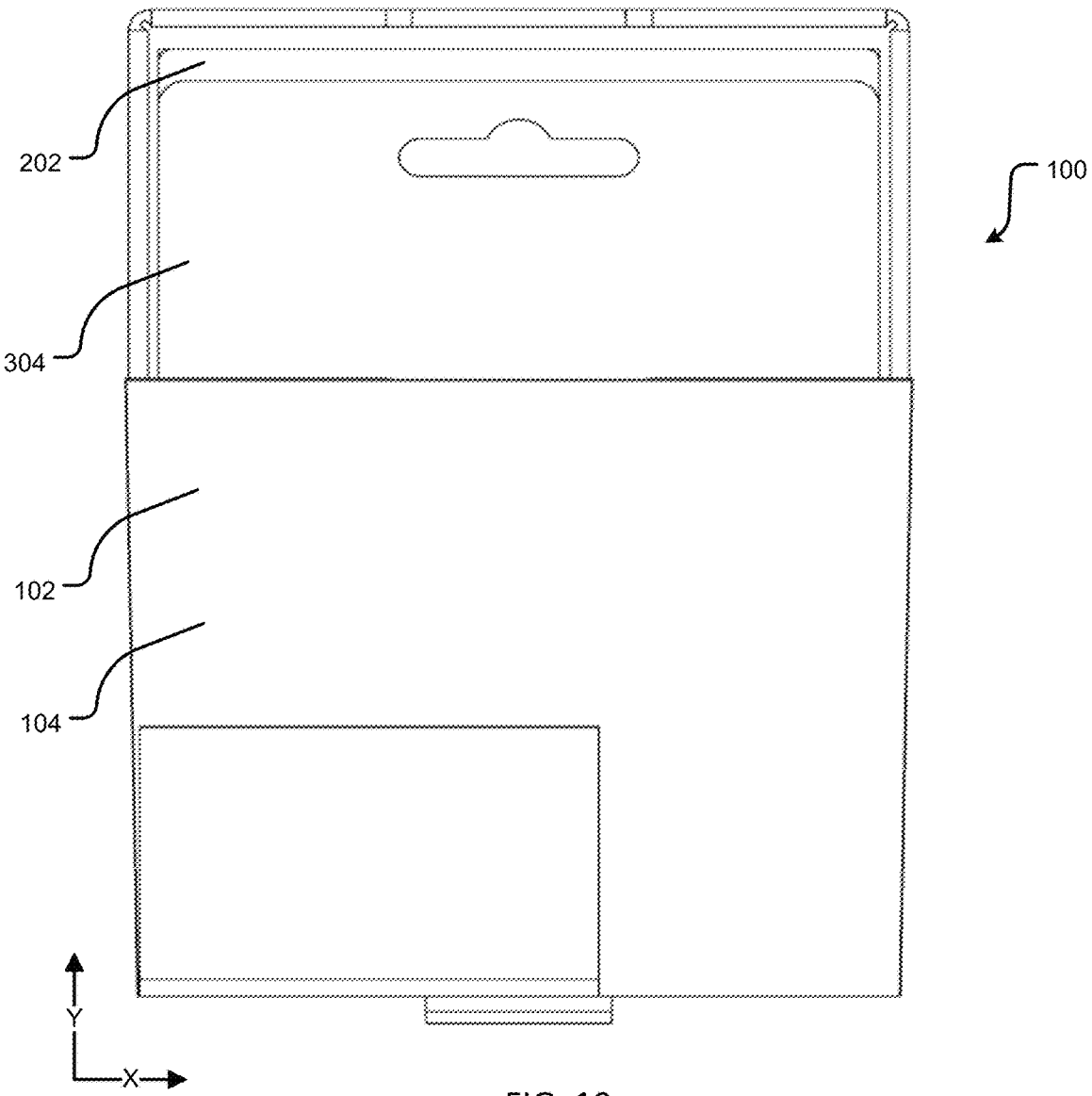
FIG. 10 illustrates a front view of the product display pusher system of FIG. 9.

FIG. 10 illustrates a front view of the product display pusher system of FIG. 9.

Figure 11:
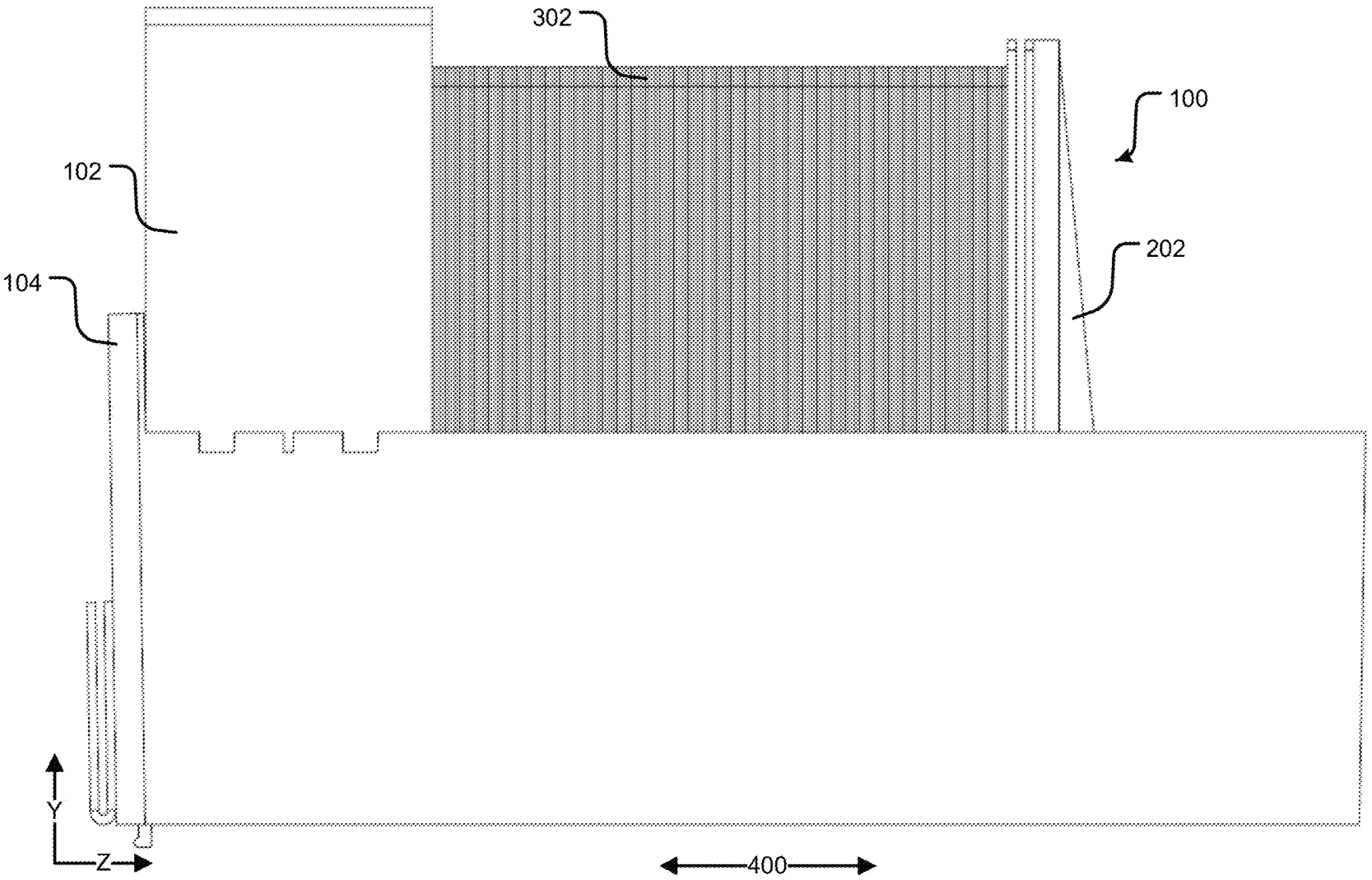
FIG. 11 illustrates a side view of the product display pusher system of FIG. 9.

FIG. 11 illustrates a side view of the product display pusher system of FIG. 9.

Figure 12:
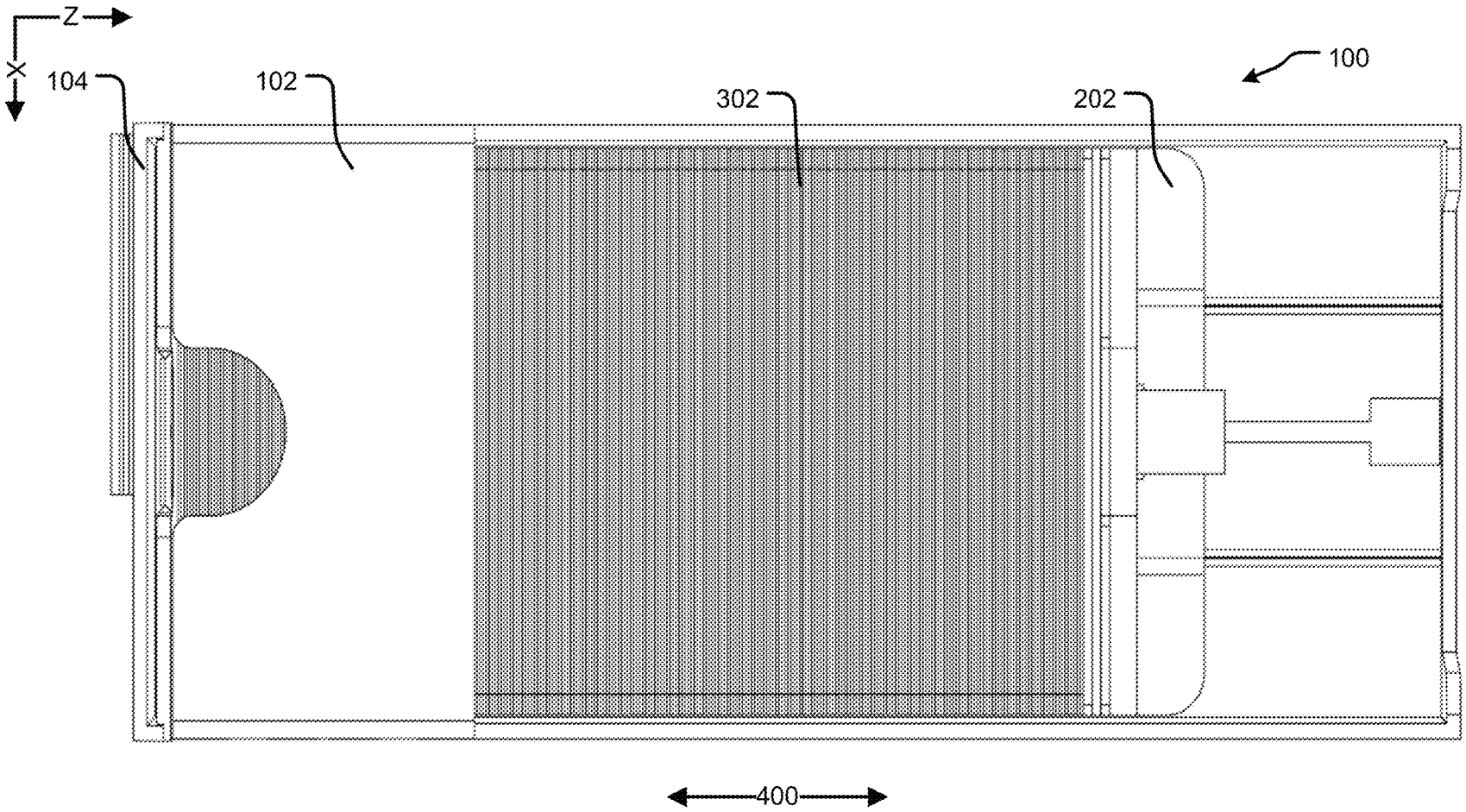
FIG. 12 illustrates a top view of the product display pusher system of FIG. 9.

FIG. 12 illustrates a top view of the product display pusher system of FIG. 9.

In particular, FIG. 9, FIG. 10, FIG. 11, and FIG. 12 illustrate a pusher tray assembly 100 that may be structured, arranged, and/or configured for holding a product 302. In this regard, the pusher tray assembly 100 may be implemented in a retail setting for display of the product 302 and subsequent sale and dispensing of the product 302 to a customer. The pusher tray assembly 100 may be located on and/or in a shelf, a cabinet, a counter, a table, a fixture, the retail product display system 700 as described herein, and/or like (hereinafter retail fixture) within a retail setting.

The pusher tray assembly 100 includes a pusher tray 102 and a pusher paddle 202. For example, the pusher tray assembly 100 is shown as a holding the product 302, which may be a card shaped product. However, the pusher tray assembly 100 can hold other shaped products and/or the pusher tray assembly 100 may be configured and/or modified to hold other shaped products.

In particular, the pusher tray assembly 100 may be configured as further described herein to have a first one of the product 304 arranged at a front end 104 of the pusher tray assembly 100. In this regard, various structures and components as described in greater detail herein allow the first one of the product 304 to be presented at the front end 104 of the pusher tray assembly 100 such that a customer in the retail setting is more likely to view the product 302 as the first one of the product 304 and the front end 104 may generally be located at a front portion of a retail fixture. In other words, the pusher tray assembly 100 holds or otherwise maintains product, such as cards, Service Plan cards, and/or the like, pushed towards the front at all times.

The pusher tray assembly 100 may be able to hold the product 302 and locate the first one of the product 304 at a front end 104 of the pusher tray assembly 100 in conjunction with the pusher paddle 202 that advances the product 302 toward the front end 104 along an axis parallel to an arrow 400 as illustrated in FIG. 9. In particular, the pusher tray assembly 100 may be configured such that a customer can remove the first one of the product 304 from the pusher tray assembly 100 and the pusher paddle 202 may advance the product 302 toward the front end 104 in order to present the next one of the product 302 as the first one of the product 304. In other words, the pusher tray assembly 100 holds or otherwise maintains product, such as cards, Service Plan cards, and/or the like, pushed towards the front at all times.

Figure 13:
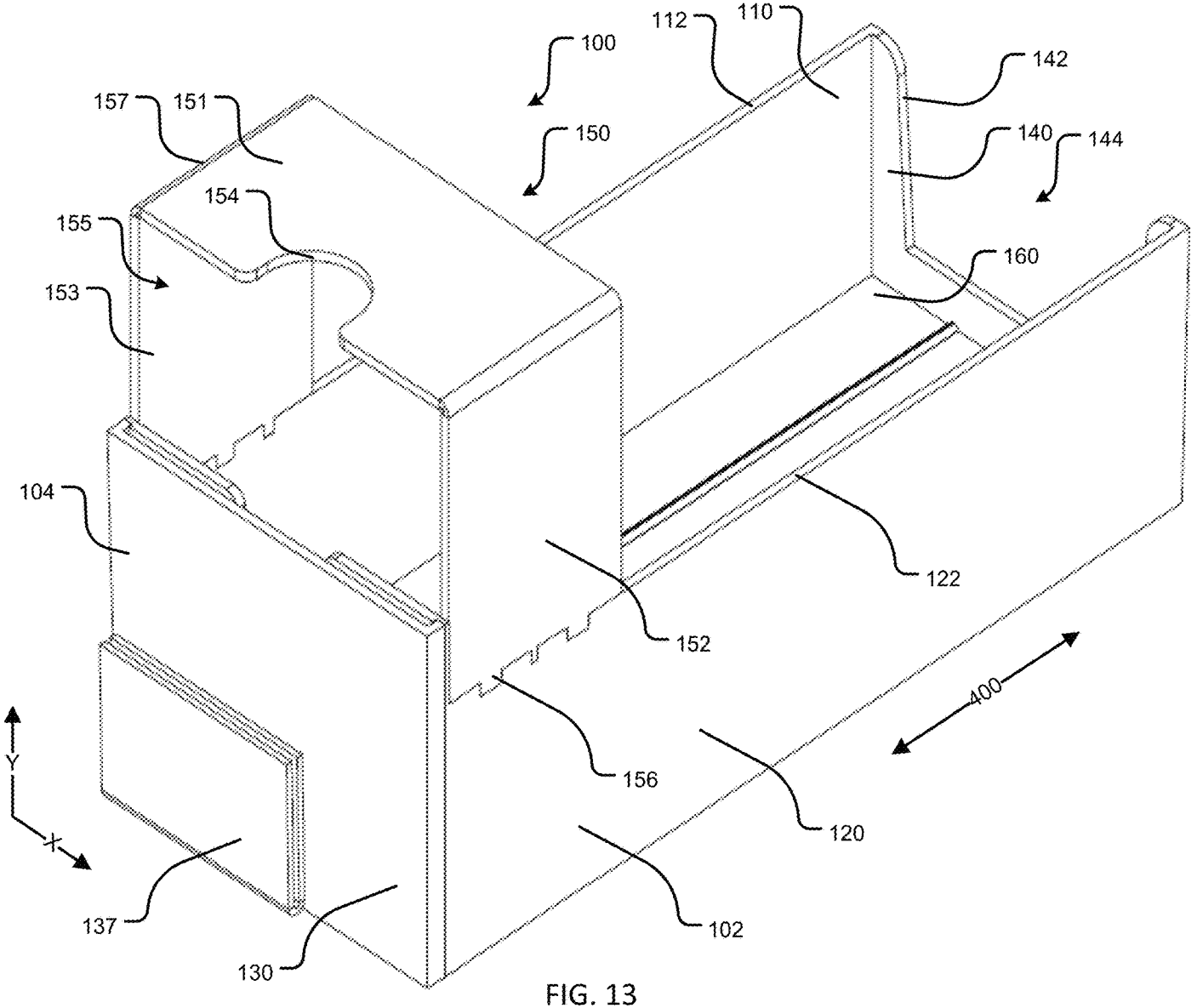
FIG. 13 illustrates a front right perspective view of the product display pusher system of FIG. 9 without product.

FIG. 13 illustrates a front right perspective view of the product display pusher system of FIG. 9 without product.

Figure 14:
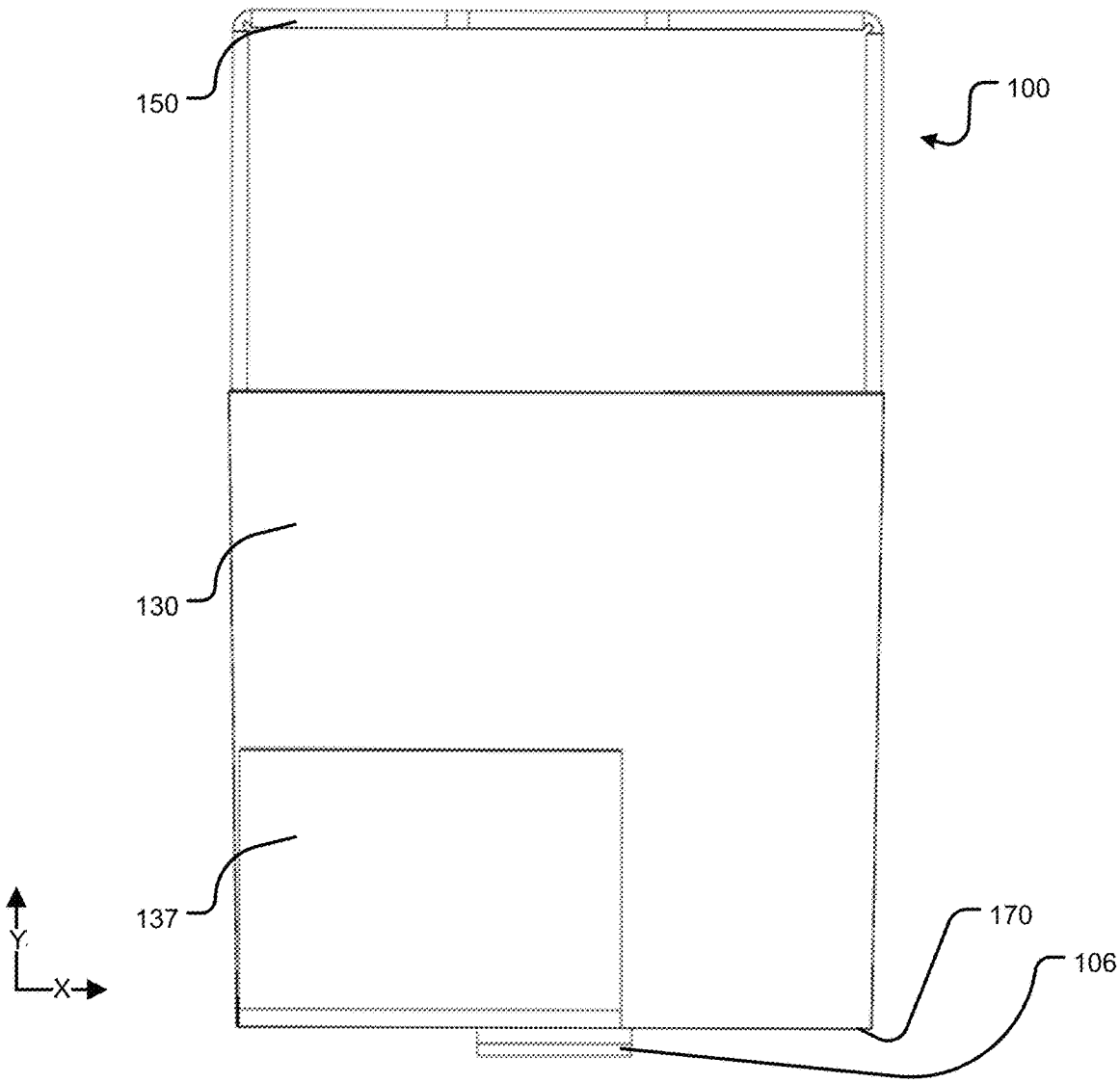
FIG. 14 illustrates a front view of the product display pusher system of FIG. 9 without product.

FIG. 14 illustrates a front view of the product display pusher system of FIG. 9 without product.

Figure 15:
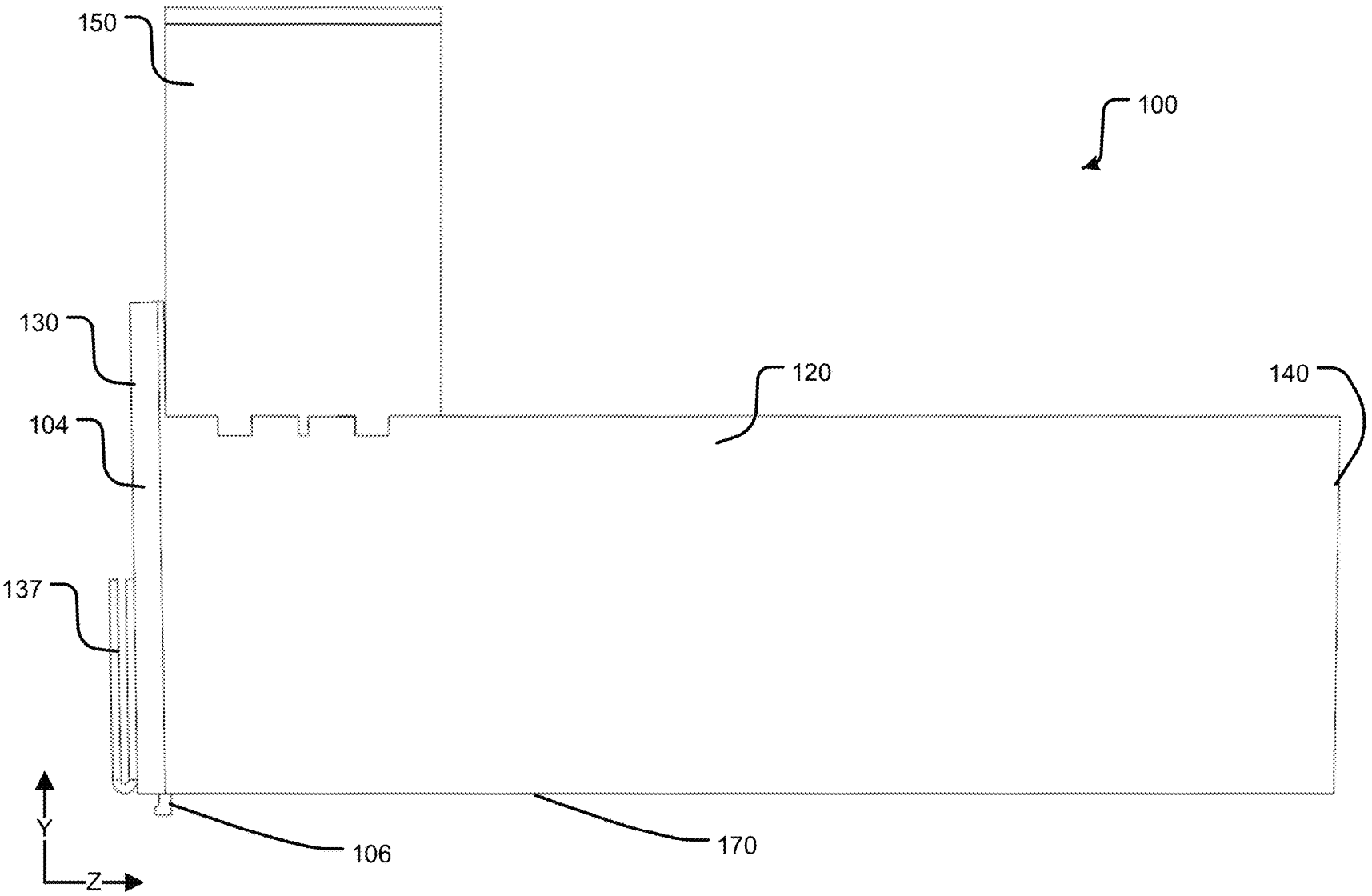
FIG. 15 illustrates a side view of the product display pusher system of FIG. 9 without product.

FIG. 15 illustrates a side view of the product display pusher system of FIG. 9 without product.

Figure 16:
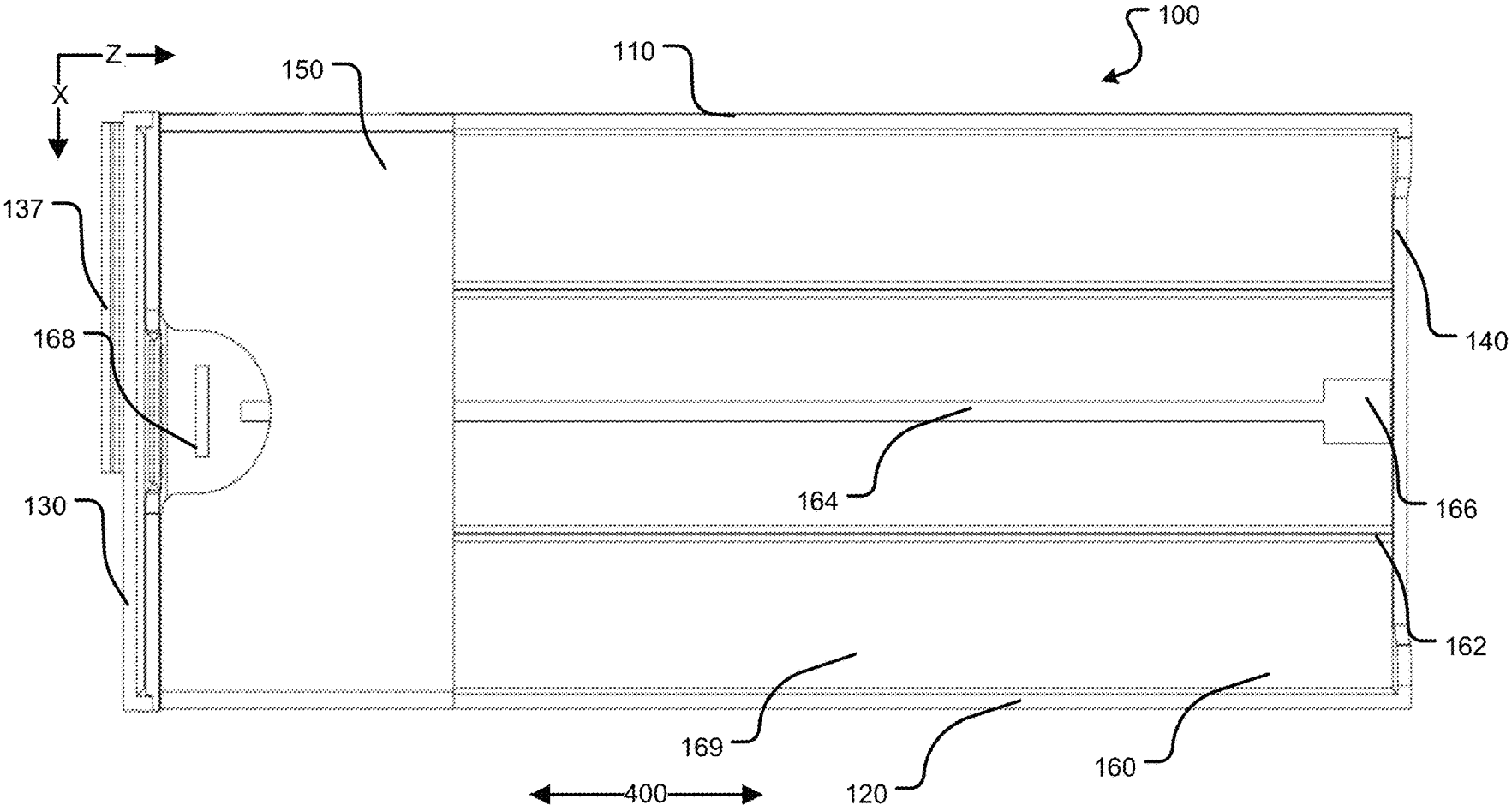
FIG. 16 illustrates a top view of the product display pusher system of FIG. 9 without product.

FIG. 16 illustrates a top view of the product display pusher system of FIG. 9 without product.

Figure 17:
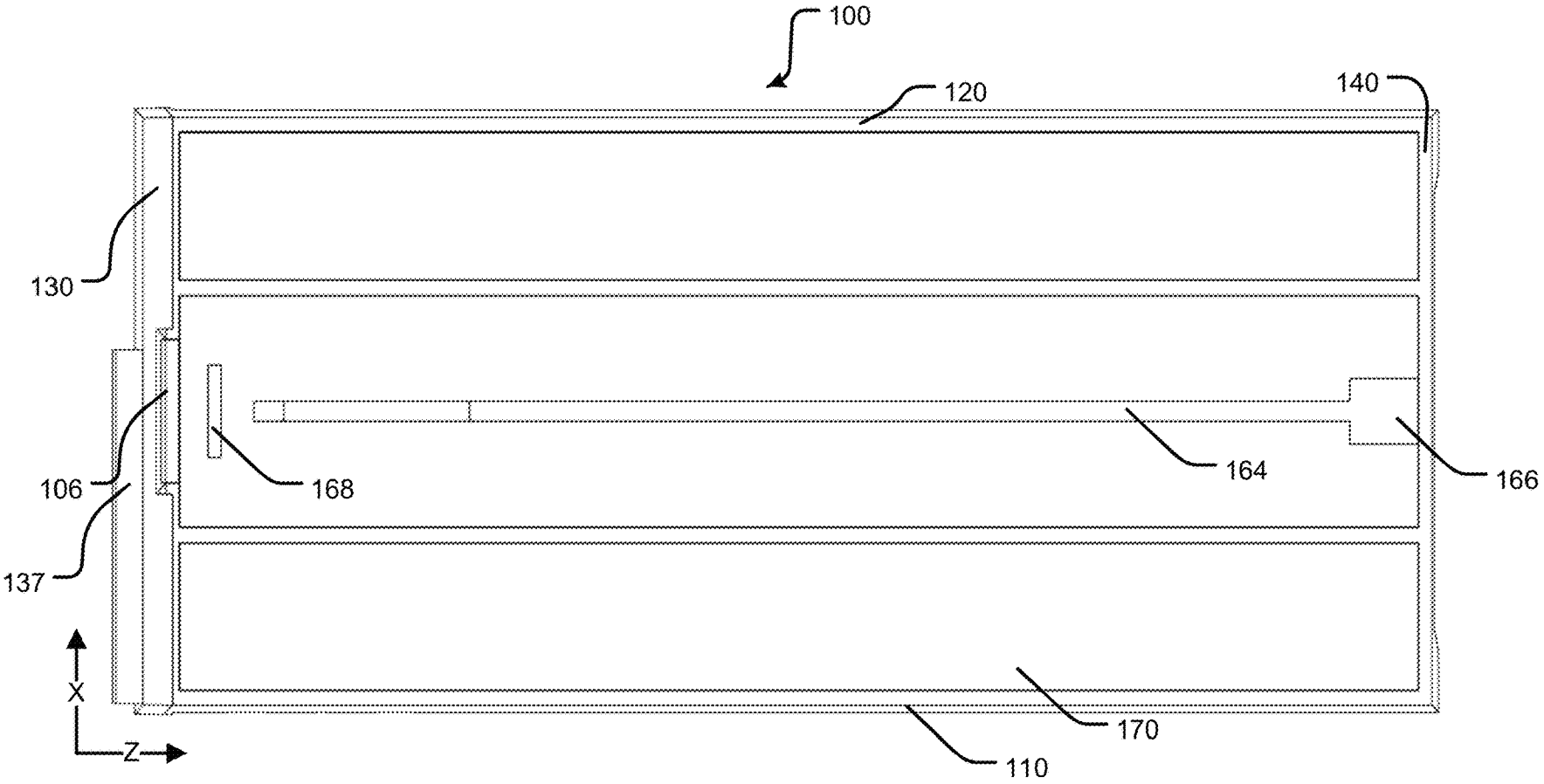
FIG. 17 illustrates a bottom view of the product display pusher system of FIG. 9 without a product.

FIG. 17 illustrates a bottom view of the product display pusher system of FIG. 9 without a product.

Figure 18:
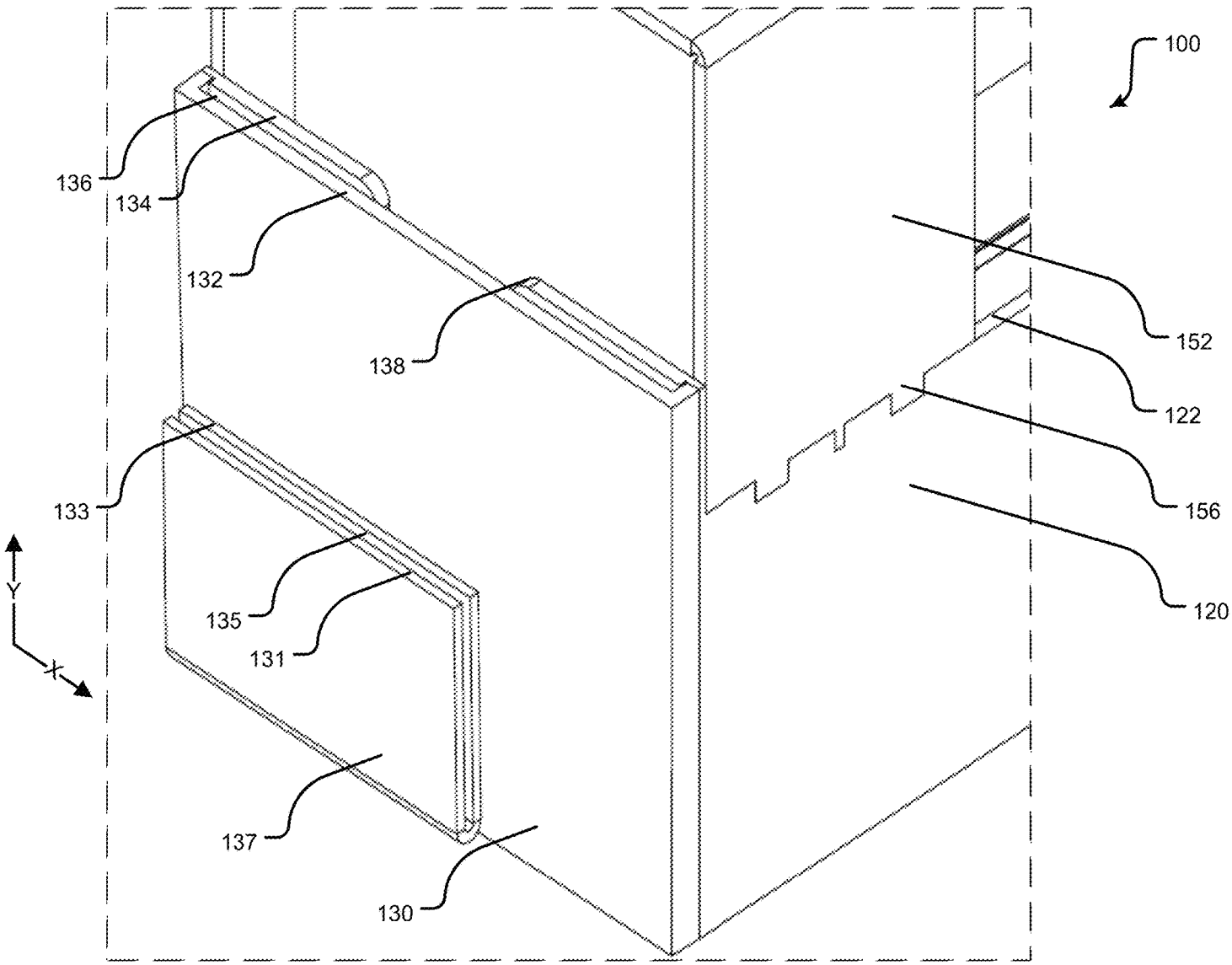
FIG. 18 illustrates a partial front right perspective view of the product display pusher system of FIG. 13.

FIG. 18 illustrates a partial front right perspective view of the product display pusher system of FIG. 13.

Figure 19:
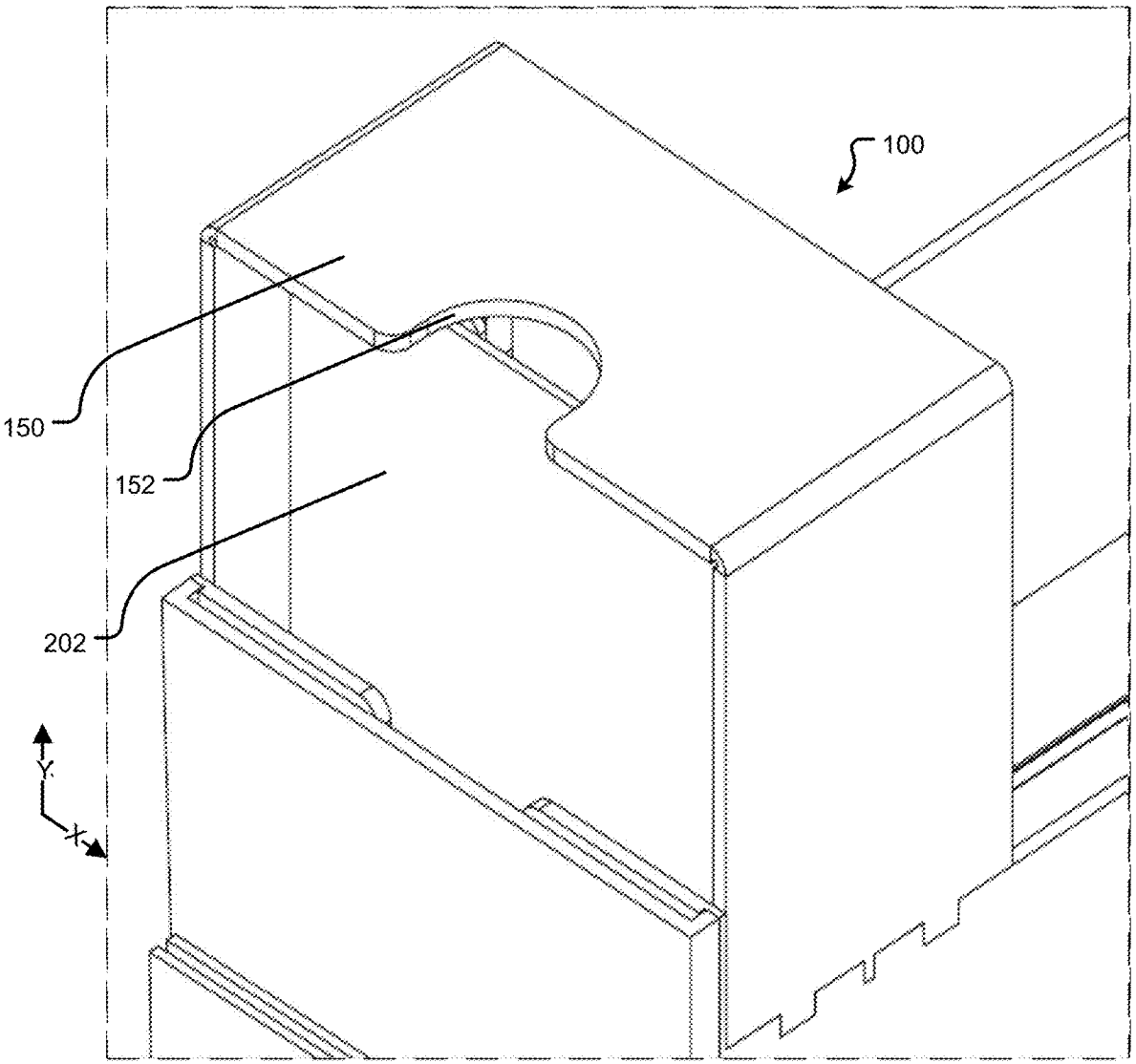
FIG. 19 illustrates a partial front right perspective view of the product display pusher system of FIG. 13.

FIG. 19 illustrates a partial front right perspective view of the product display pusher system of FIG. 13.

In particular, FIGS. 13-19 illustrate the pusher tray assembly 100 without the product 302 and/or the pusher paddle 202 for ease of illustration and understanding. The pusher tray 102 may include a floor 160, a sidewall 110, a sidewall 120, a front wall 130, and/or a back wall 140. With reference to FIG. 9 and FIG. 13, the product 302 may be arranged within the pusher tray 102 on the floor 160 between the sidewall 110, the sidewall 120, the front wall 130, the back wall 140, and the pusher paddle 202.

The sidewall 110 may be a generally rectangular structure extending between the back wall 140 and the front wall 130 along a z-axis (an axis perpendicular to the y-axis and x-axis). Additionally, the sidewall 110 may extend down to the floor 160. The sidewall 110 may include an upper edge 112 that may extend between the front wall 130 and the back wall 140. The sidewall 110 may include a material that is synthetic, plastic, bioplastic, polymer, plastic composite, and/or the like. In one or more aspects, the sidewall 110 may include a transparent and/or translucent material. The sidewall 110 may be molded, three dimensionally printed, injection molded, machined, and/or the like. Moreover, the sidewall 110 may be molded, three dimensionally printed, injection molded, machined, and/or the like as a structure that is integrated with one or more other components of the pusher tray assembly 100. In one aspect, the sidewall 110 may be molded, three dimensionally printed, injection molded, machined, and/or printed, injection molded, machined, and/or the like as a structure that is integrated with the back wall 140, the floor 160, and/or the sidewall 120. Additionally or alternatively, the sidewall 110 may be attached to other components of the pusher tray assembly 100 by welding, ultrasonic welding, an adhesive, and/or the like.

The sidewall 120 may be a generally rectangular structure extending between the back wall 140 and the front wall 130 along a z-axis (an axis perpendicular to the y-axis and x-axis). Additionally, the sidewall 120 may extend down to the floor 160. The sidewall 120 may include an upper edge 122 that may extend between the front wall 130 and the back wall 140. The sidewall 120 may include a material that is synthetic, plastic, bioplastic, polymer, plastic composite, and/or the like. In one or more aspects, the sidewall 120 may include a transparent and/or translucent material. The sidewall 120 may be molded, three dimensionally printed, injection molded, machined, and/or printed, injection molded, machined, and/or the like. Moreover, the sidewall 120 may be molded, three dimensionally printed, injection molded, machined, and/or printed, injection molded, machined, and/or the like as a structure that is integrated with one or more other components of the pusher tray assembly 100. In one aspect, the sidewall 120 may be molded, three dimensionally printed, injection molded, machined, and/or the like as a structure that is integrated with the back wall 140, the floor 160, and/or the sidewall 110. Additionally or alternatively, the sidewall 120 may be attached to other components of the pusher tray assembly 100 by welding, ultrasonic welding, an adhesive, and/or the like.

The back wall 140 may be a structure extending between the sidewall 110 and the sidewall 120 along the y-axis and the x-axis. Additionally, the back wall 140 may extend down to the floor 160. The back wall 140 may include an upper edge 142 that may extend between the sidewall 110 and the sidewall 120. In one aspect, the back wall 140 may include the upper edge 142 structured and arranged to form an opening 144 between the sidewall 110 and the sidewall 120.

The back wall 140 may include a material that is synthetic, plastic, bioplastic, polymer, plastic composite, and/or the like. In one or more aspects, the back wall 140 may include a transparent and/or translucent material. The back wall 140 may be molded, three dimensionally printed, injection molded, machined, and/or the like. Moreover, the back wall 140 may be molded, three dimensionally printed, injection molded, machined, and/or the like as a structure that is integrated with one or more other components of the pusher tray assembly 100. In one aspect, the back wall 140 may be molded, three dimensionally printed, injection molded, machined, and/or the like as a structure that is integrated with the sidewall 120, the floor 160, and/or the sidewall 110. Additionally or alternatively, the back wall 140 may be attached to other components of the pusher tray assembly 100 by welding, ultrasonic welding, an adhesive, and/or the like.

The front wall 130 may be located at the front end 104 of the pusher tray assembly 100. The front wall 130 may be attached to the sidewall 110 and the sidewall 120 along a surface that is within a plane of the y-axis and the x-axis. The front wall 130 may include a material that is synthetic, plastic, bioplastic, polymer, plastic composite, and/or the like. In one or more aspects, the front wall 130 may include a transparent and/or translucent material. In this regard, the front wall 130 may be configured to hold a graphic medium inside. Accordingly, the front wall 130 implementing transparent material may allow the customer to see the graphic medium inside the front wall 130. Moreover, the front wall 130 may protect the graphic medium from damage.

The front wall 130 may be molded, three dimensionally printed, injection molded, machined, and/or the like. In one aspect, the front wall 130 may be molded, three dimensionally printed, injection molded, machined, and/or the like as a structure that is integrated with the sidewall 110, the sidewall 120, and/or the floor 160. Additionally or alternatively, the front wall 130 may be attached to other components of the pusher tray assembly 100 by welding, ultrasonic welding, an adhesive, and/or the like.

The pusher tray assembly 100 may include an inventory control bar 150. The inventory control bar 150 may be attached at the front end 104 of the pusher tray assembly 100. The inventory control bar 150 may be attached to the upper edge 112 of the sidewall 110 and the upper edge 122 of the sidewall 120. The inventory control bar 150 may include a material that is synthetic, plastic, bioplastic, polymer, plastic composite, and/or the like. In one or more aspects, the inventory control bar 150 may include a transparent and/or translucent material.

The inventory control bar 150 may be molded, three dimensionally printed, injection molded, machined, and/or the like. In one aspect, the inventory control bar 150 may be attached to the sidewall 110 and the sidewall 120 as described with reference to FIG. 19. In one aspect, the inventory control bar 150 may be molded, three dimensionally printed, injection molded, machined, and/or the like as a structure that is integrated with the sidewall 110, the sidewall 120, and/or the front wall 130. Additionally or alternatively, the inventory control bar 150 may be attached to other components of the pusher tray assembly 100 by welding, ultrasonic welding, an adhesive, and/or the like.

The inventory control bar 150 may be configured to at least partially cover the product 302 and/or the first one of the product 304. In one aspect, the inventory control bar 150 may be configured to ensure that the product 302 remains neatly within the pusher tray assembly 100, arranged on the floor 160, and/or the like. In one aspect, the inventory control bar 150 retains the stack of cards together as you pull the front card Avoiding "Spillage" of cards.

The inventory control bar 150 may include a top portion 151, a side portion 152, a side portion 153, a finger relief 154, an opening 155, connection portions 156, and corner portions 157. In this regard, the top portion 151, the side portion 152, the side portion 153, the finger relief 154 (finger slot or finger access slot), the opening 155, the connection portions 156, and the corner portions 157 of the inventory control bar 150 together with the floor 160, the sidewall 110, the front wall 130, the sidewall 120, and/or the pusher paddle 202 may be configured to ensure that the product 302 remains neatly within the pusher tray assembly 100. In one aspect, the finger relief 154 makes it easier for the product 302, such as a first card, to be pulled with ease.

In one aspect, the inventory control bar 150 may be configured to surround an upper portion of the product 302. In one aspect, the inventory control bar 150 may be configured to ensure only one of the product 302 is dispensed at a time. In one aspect, the inventory control bar 150 may be configured to surround the product 302 in conjunction with the pusher tray 102. In one aspect, the inventory control bar 150 may be configured to allow the pusher paddle 202 and/or the product 302 to travel therethrough. In one aspect, the inventory control bar 150 may be configured to cover the product 302. In one aspect, the inventory control bar 150 may be configured to cover the pusher paddle 202.

The connection portions 156 may be configured to join the inventory control bar 150 to the pusher tray 102. In this regard, the connection portions 156 may include any type of mechanical fastening connection. The inventory control bar 150 may form a separate structure from the remainder of the pusher tray assembly 100 and this may make manufacturing easier. In certain aspects it may be beneficial or desired to include the inventory control bar 150 with the pusher tray assembly 100. Accordingly, the inventory control bar 150 may be attached to the pusher tray 102 with the connection portions 156. On the other hand, in certain aspects it may be beneficial or decide to not include the inventory control bar 150 with the pusher tray assembly 100. In this case, the inventory control bar 150 may be detached from the pusher tray 102 utilizing the connection portions 156.

In one aspect, the connection portions 156 may be configured as dove tail structures that form interdigital portions. More specifically, the connection portions 156 may be configured with dove tail structures on both the inventory control bar 150 and the sidewall 120. These dove tail structures cooperate to provide a sturdy and rigid connection between the inventory control bar 150 and the sidewall 120. Moreover, these dove tail structures allow for separation of the inventory control bar 150 from the sidewall 120. In one aspect, the connection portions 156 may be configured with a snap fit, a press-fit, and/or the like constructions to maintain a sturdy and rigid connection between the inventory control bar 150 and the sidewall 120.

The connection portions 156 may be arranged and extend in part from the side portion 152 downwardly from the inventory control bar 150 along the y-axis. Corresponding portions of the connection portions 156 may be arranged on the upper edge 122 and/or the sidewall 120 and extend vertically along the y-axis from the pusher tray 102. Although FIG. 18 illustrates the implementation of the connection portions 156 as it relates to the sidewall 120, a similar construction of the connection portions 156 may be implemented in conjunction with the sidewall 110.

The top portion 151 of the inventory control bar 150 may be generally located in a plane parallel to the x-axis and the z-axis. The top portion 151 may extend to, be integrated with, and/or connect to the corner portions 157. The top portion 151 may further include the finger relief 154. With reference to FIG. 9 and FIG. 13, the finger relief 154 allows a customer to more easily grab the first one of the product 304 that is held within the inventory control bar 150 of the pusher tray assembly 100. The pusher tray assembly 100 may also be implemented without the finger relief 154.

The corner portions 157 may connect the top portion 151 to the side portion 152 and likewise the top portion 151 to the side portion 153. The side portion 152 and the side portion 153 may be arranged in a plane generally parallel to the y-axis and the z-axis. The combination of the top portion 151, the side portion 152, the side portion 153, and/or the corner portions 157 may form the inventory control bar 150 that partially surrounds the product 302 and/or the first one of the product 304. In one aspect, the inventory control bar 150 may surround an upper portion of the product 302 and/or the first one of the product 304 and the front wall 130, the sidewall 110, the sidewall 120, and/or the floor 160 may surround a lower portion of the product 302 and/or the first one of the product 304.

Additionally, the combination of the top portion 151, the side portion 152, the side portion 153, and/or the corner portions 157 may form the opening 155. The opening 155 may be utilized by the customer to access, retrieve, remove, and/or dispense the product 302 and/or the first one of the product 304 from the pusher tray assembly 100.

Any one or more of the components of the inventory control bar 150 may be molded, three dimensionally printed, injection molded, machined, and/or the like. Additionally or alternatively, any one or more of the components of the inventory control bar 150 may be attached to other components of the pusher tray assembly 100 by welding, ultrasonic welding, an adhesive, and/or the like.

With reference to FIG. 16, the floor 160 may include at least one rail 162, at least one slot 164, at least one slot opening 166, a slot 168, an upper surface 169, and/or a bottom wall 170. The floor 160 may be a structure extending between the sidewall 110 and the sidewall 120 along the x-axis.

Additionally, the floor 160 may be a structure extending between the front wall 130 and the back wall 140 along the z-axis and/or in a plane parallel to the x-axis and the z-axis. The floor 160 may include a material that is synthetic, plastic, bioplastic, polymer, plastic composite, and/or the like. In one or more aspects, the floor 160 may include a transparent and/or translucent material. The floor 160 may be molded, three dimensionally printed, injection molded, machined, and/or the like. Moreover, the floor 160 may be molded, three dimensionally printed, injection molded, machined, and/or the like as a structure that may be integrated with one or more other components of the pusher tray assembly 100. In one aspect, the floor 160 may be molded, three dimensionally printed, injection molded, machined, and/or the like as a structure that may be integrated with the sidewall 120, the back wall 140, and/or the sidewall 110. Additionally or alternatively, the floor 160 may be attached to other components of the pusher tray assembly 100 by welding, ultrasonic welding, an adhesive, and/or the like.

With further reference to FIG. 16, the pusher tray assembly 100 may include the at least one rail 162 arranged on the upper surface 169. The at least one rail 162 may extend from the back wall 140 to the front wall 130 along the z-axis. The at least one rail 162 may include an elevated surface that extends above the upper surface 169. The product 302 may be positioned on the at least one rail 162 and may slide along the at least one rail 162 parallel to the arrow 400. The at least one rail 162 may include two or more implementations of the at least one rail 162. In one aspect, there may be dual implementations of the at least one rail 162 arranged symmetrically on either side of the at least one slot 164 in order to minimize product friction.

The at least one rail 162 may be raised portions of material on the floor 160. The at least one rail 162 may form the contact surfaces on which a bottom surface of the product may be supported. The at least one rail 162 may result in a small contact surface on which the bottom surface of the product is supported thus reducing friction. This small surface and reduced friction ensures that product slides along arrow 400 toward the front wall 130 as urged by the pusher paddle 202 in response to a force provided by a spring 600 (described below with reference to FIG. 27 and FIG. 28).

The at least one rail 162 may include a material that is synthetic, plastic, bioplastic, polymer, plastic composite, and/or the like. In one or more aspects, the at least one rail 162 may include a transparent and/or translucent material. The at least one rail 162 may be molded, three dimensionally printed, injection molded, machined, and/or the like. Moreover, the at least one rail 162 may be molded, three dimensionally printed, injection molded, machined, and/or the like as a structure that may be integrated with one or more other components of the pusher tray assembly 100. In one aspect, the at least one rail 162 may be molded, three dimensionally printed, injection molded, machined, and/or the like as a structure that may be integrated with the floor 160.

The sidewall 110 may be connected to the floor 160 along the edges thereof. The sidewall 110 may extend perpendicularly from the major surface of the floor 160. In one aspect, the sidewall 110 may extend perpendicularly from the major surface of the floor 160 vertically. Likewise, the back wall 140 may be connected to the floor 160 along the edges thereof. The back wall 140 may extend perpendicularly from the major surface of the floor 160. In one aspect, the back wall 140 may extend perpendicularly from the major surface of the floor 160 vertically.

In particular aspects with reference to FIG. 18, the front wall 130 may include an outer surface structure 132 that may be generally arranged within a plane parallel to the y-axis and the x-axis. Additionally, the front wall 130 may include an inner surface structure 134 that may be generally arranged within a plane parallel to the y-axis and the x-axis. The outer surface structure 132 and the inner surface structure 134 may form a slot 136 therebetween. The slot 136 may be arranged or generally arranged within a plane parallel to the y-axis and the x-axis. In one aspect, the slot 136 may have an opening at an upper end of the front wall 130. The front wall 130 may include closed side edges and/or closed bottom edges such that the slot 136 has an internal bottom surface and/or internal side surfaces. The slot 136 may be configured to receive a graphic medium such as a card or the like. The slot 136 may hold the graphic medium therein and in implementations where the front wall 130 may be transparent, the graphic medium and any printing thereon may be seen through the transparent material of the front wall 130. For example, the graphic medium may be a price tag, a barcode, a product description, a sign, a promotional sign, plan information, plan update information, signage, a price card, pricing signage, a QR code, and/or the like. In this regard, the slot 136 may implement a front "Graphic Holder" that allows for special promotional signs or plan update information to be clearly shown on the front of each card pusher tray.

The front wall 130 and in particular the inner surface structure 134 may include a cutout portion 138 (finger relief, finger slot, or finger access slot) that allows stocking personnel to more easily grasp the graphic medium that may be arranged in the slot 136. In other words, the cutout portion 138 forms a finger slot for the stocking personnel to contact, grab, remove, and/or replace the graphic medium that may be arranged in the slot 136.

The pusher tray assembly 100 may further include a channel portion 137 that may be attached to the front wall 130. The channel portion 137 may be attached to the front wall 130 along a surface that may be within a plane parallel to the y-axis and the x-axis. The channel portion 137 may include a material that is synthetic, plastic, bioplastic, polymer, plastic composite, and/or the like. In one or more aspects, the channel portion 137 may include a transparent and/or translucent material. In this regard, the channel portion 137 may be configured to hold a graphic medium inside. The channel portion 137 may be molded, three dimensionally printed, injection molded, machined, and/or the like.

In particular aspects, the channel portion 137 may include an outer surface structure 131 that may be generally arranged within a plane parallel to the y-axis and the x-axis. Additionally, the channel portion 137 may include an inner surface structure 133 that may be generally arranged within a plane parallel to the y-axis and the x-axis. The outer surface structure 131 and the inner surface structure 133 may form a slot 135 therebetween. The slot 135 may be arranged or generally arranged within a plane parallel to the y-axis and the x-axis. In one aspect, the slot 135 may have an opening at an upper end of the channel portion 137. The channel portion 137 may include closed bottom edges such that the slot 135 has an internal bottom surface. The slot 135 may be configured to receive a graphic medium such as a card or the like. The slot 135 may hold the graphic medium therein and in implementations where the channel portion 137 is transparent, the graphic medium and any printing thereon, may be seen through the transparent material of the channel portion 137. For example, the graphic medium may be a price tag, a barcode, a product description, a sign, a promotional sign, plan information, plan update information, signage, a price card, pricing signage, a QR code, and/or the like. In this regard, the channel portion 137 allows for the store to place the pricing signage on the front of each tray for easy visibility.

With reference to FIG. 14, FIG. 15, and FIG. 17, the pusher tray assembly 100 may further include a locking feature 106. The locking feature 106 may extend vertically downwardly along the y-axis from the bottom wall 170 and may be engaged with a corresponding slot located on a retail fixture. The locking feature 106 may be a generally rectangular extension that extends along a partial width of the bottom wall 170 along the x-axis as illustrated in FIG. 14. Moreover, the locking feature 106 may include a horizontal extension as shown in FIG. 15 that extends toward the front end 104 along the z-axis.

In one or more aspects, the locking feature 106 may be configured to flex. In this regard, the locking feature 106 may operate as a snap feature to engage and a lock to the retail fixture. In one aspect, the locking feature 106 may engage the corresponding slot located on a retail fixture and prevent forward movement of the pusher tray assembly 100. Forward movement of the pusher tray assembly 100 would result in the pusher tray assembly 100 falling out of the front of the retail fixture on which it is positioned. Additionally, engagement of the locking feature 106 to the corresponding slot also prevents vertical movement of the pusher tray assembly 100. Accordingly, a customer can grasp a product and lift the product vertically from the pusher tray assembly 100 without the pusher tray assembly 100 lifting off the retail fixture on which it may be supported. Other or alternative locking features are contemplated as well.

Figure 20:
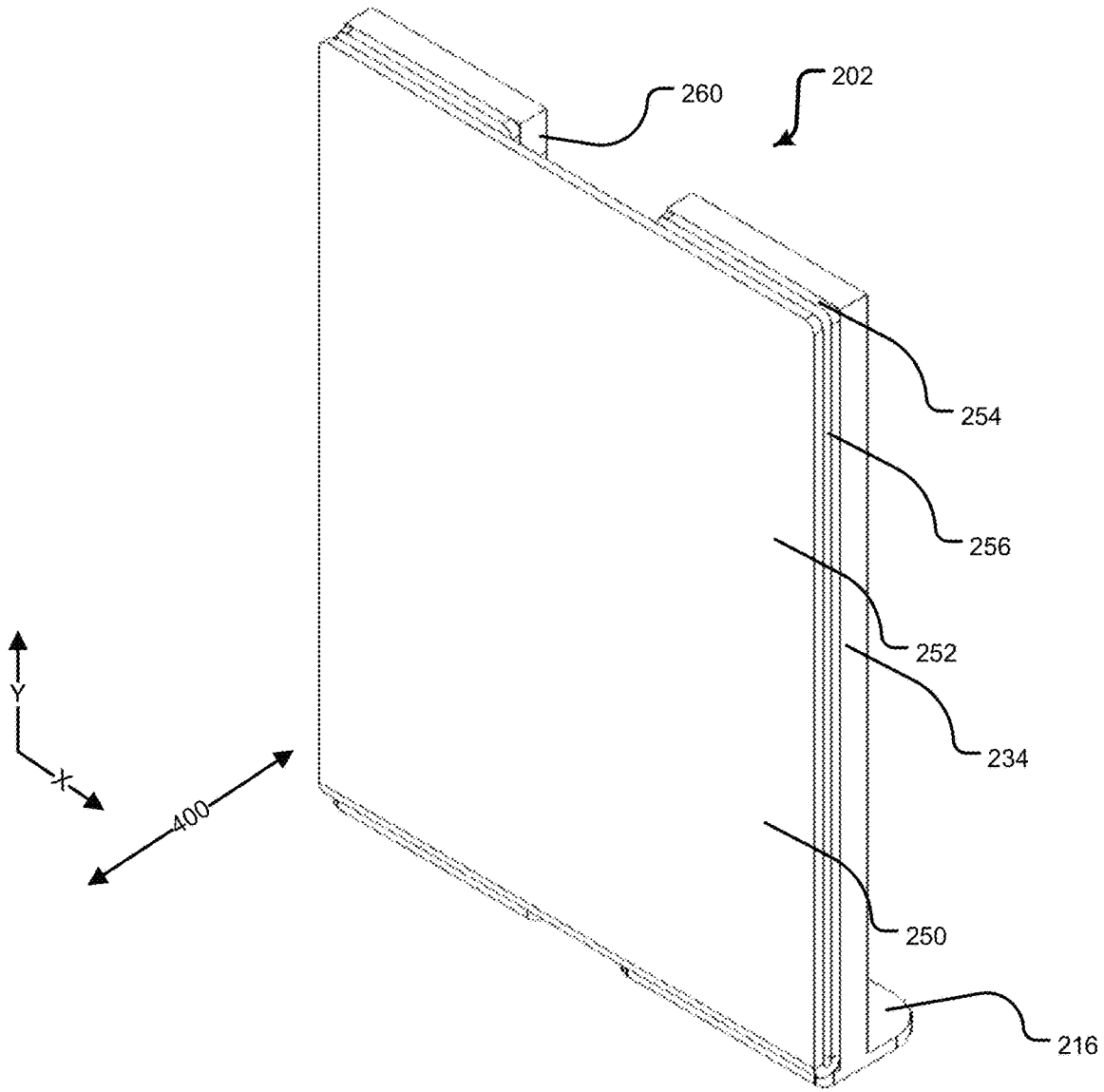
FIG. 20 illustrates a front perspective view of a pusher paddle of the product display pusher system of FIG. 9.

FIG. 20 illustrates a front perspective view of a pusher paddle of the product display pusher system of FIG. 9.

Figure 21:
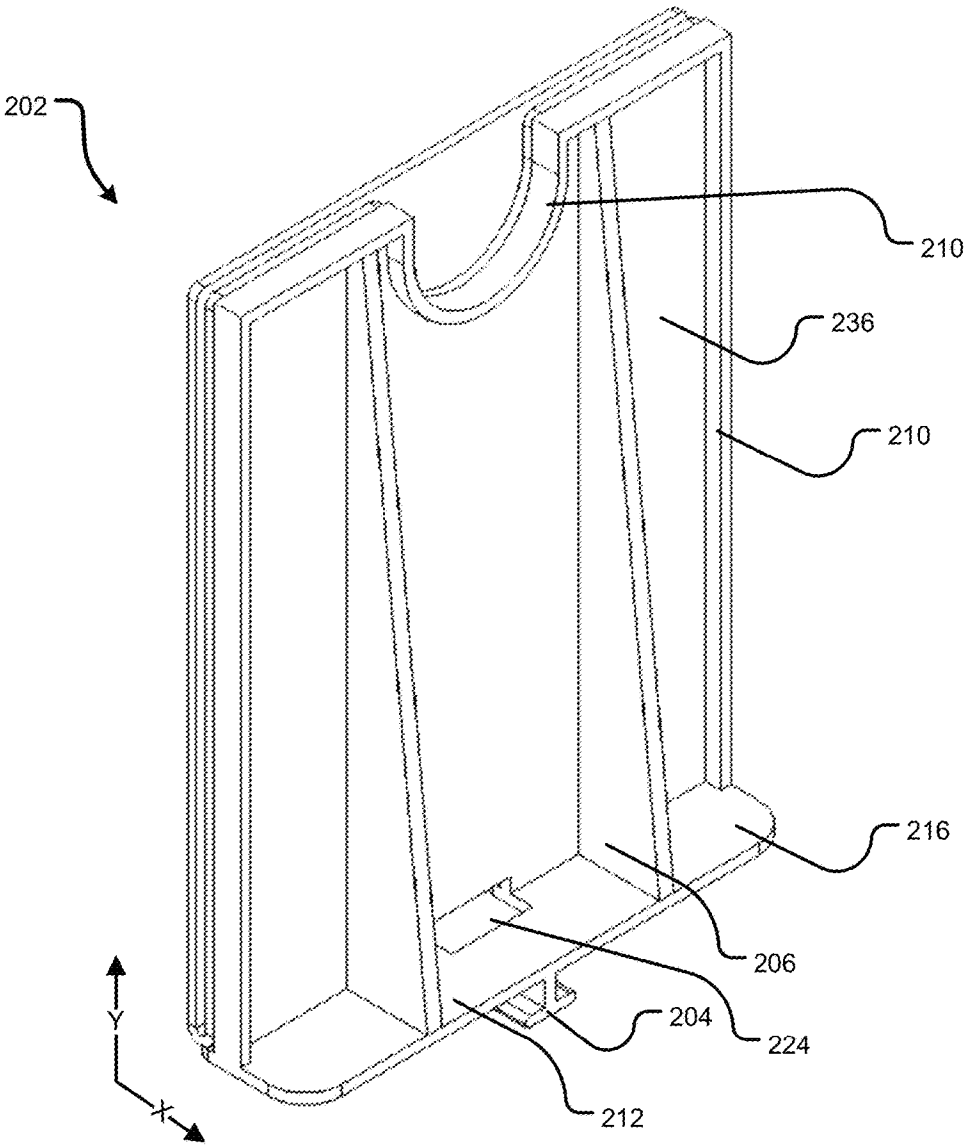
FIG. 21 illustrates a back perspective view of the pusher paddle of FIG. 20.

FIG. 21 illustrates a back perspective view of the pusher paddle of FIG. 20.

Figure 22:
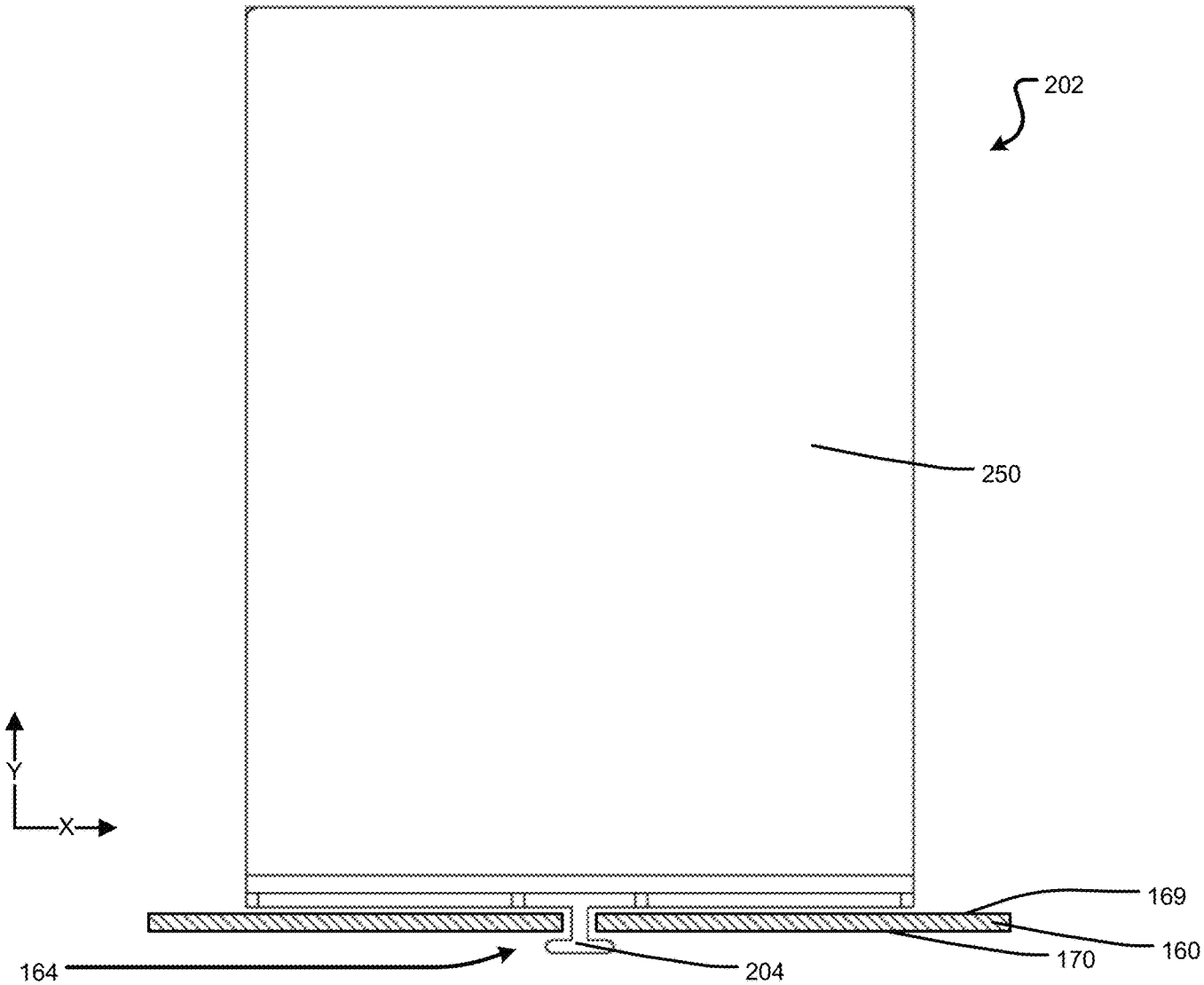
FIG. 22 illustrates a front view of the pusher paddle of FIG. 20.

FIG. 22 illustrates a front view of the pusher paddle of FIG. 20.

Figure 23:
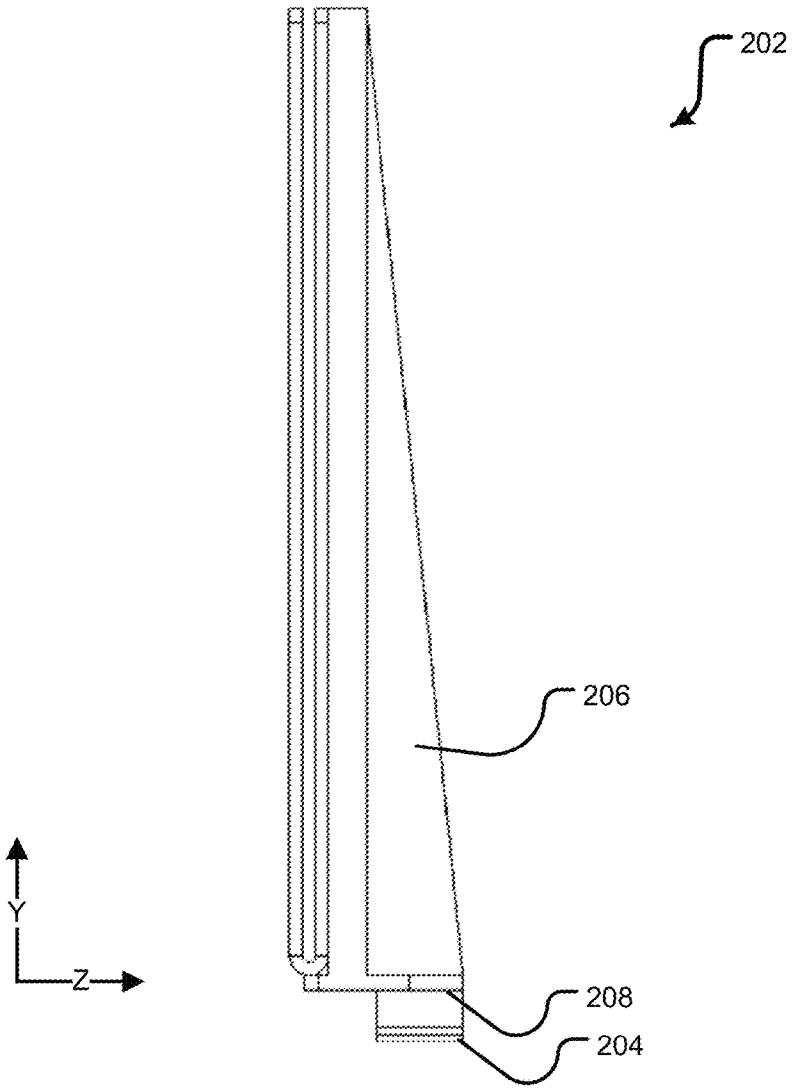
FIG. 23 illustrates a side view of the pusher paddle of FIG. 20.

FIG. 23 illustrates a side view of the pusher paddle of FIG. 20.

Figure 24:
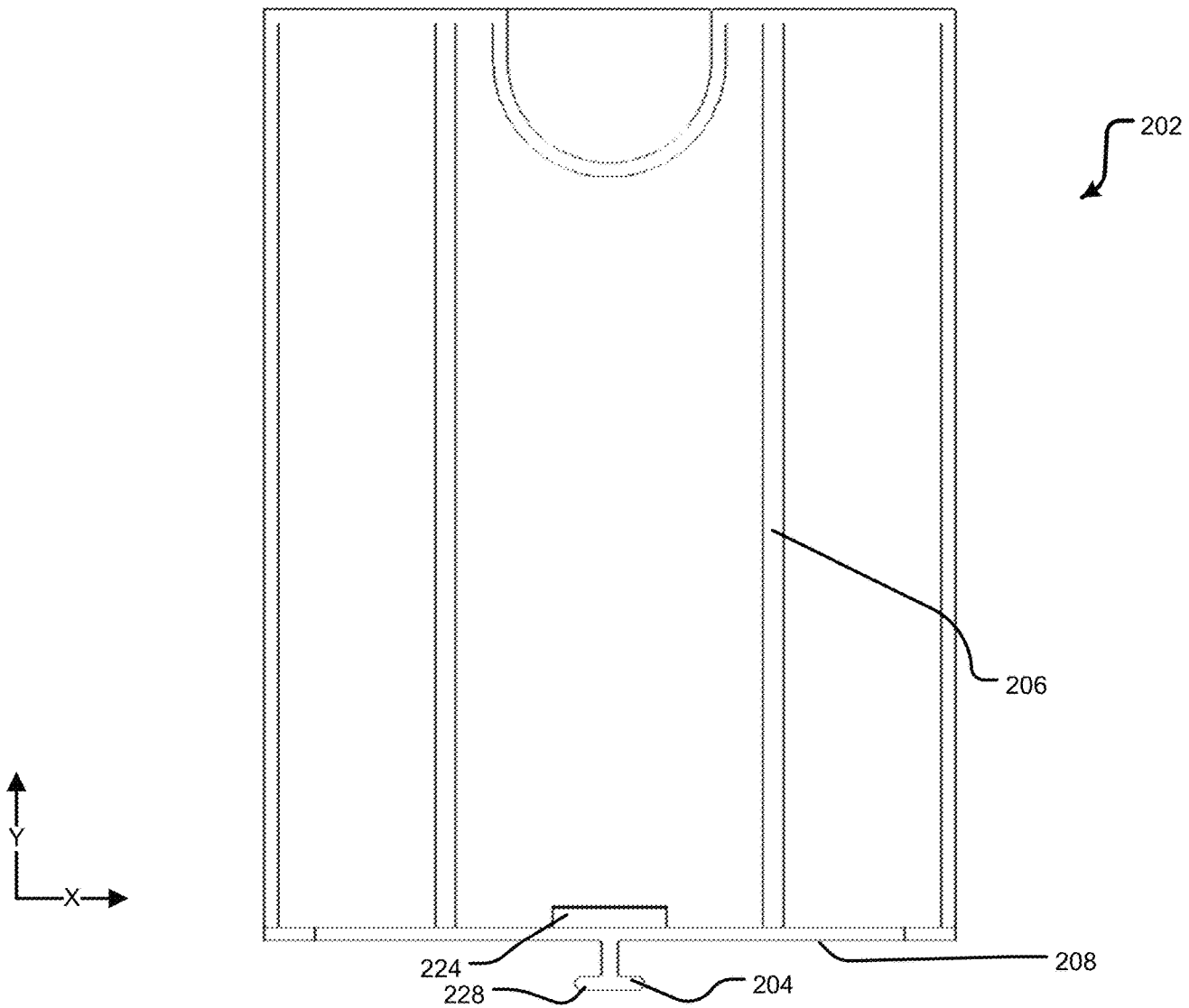
FIG. 24 illustrates a back view of the pusher paddle of FIG. 20.

FIG. 24 illustrates a back view of the pusher paddle of FIG. 20.

Figure 25:
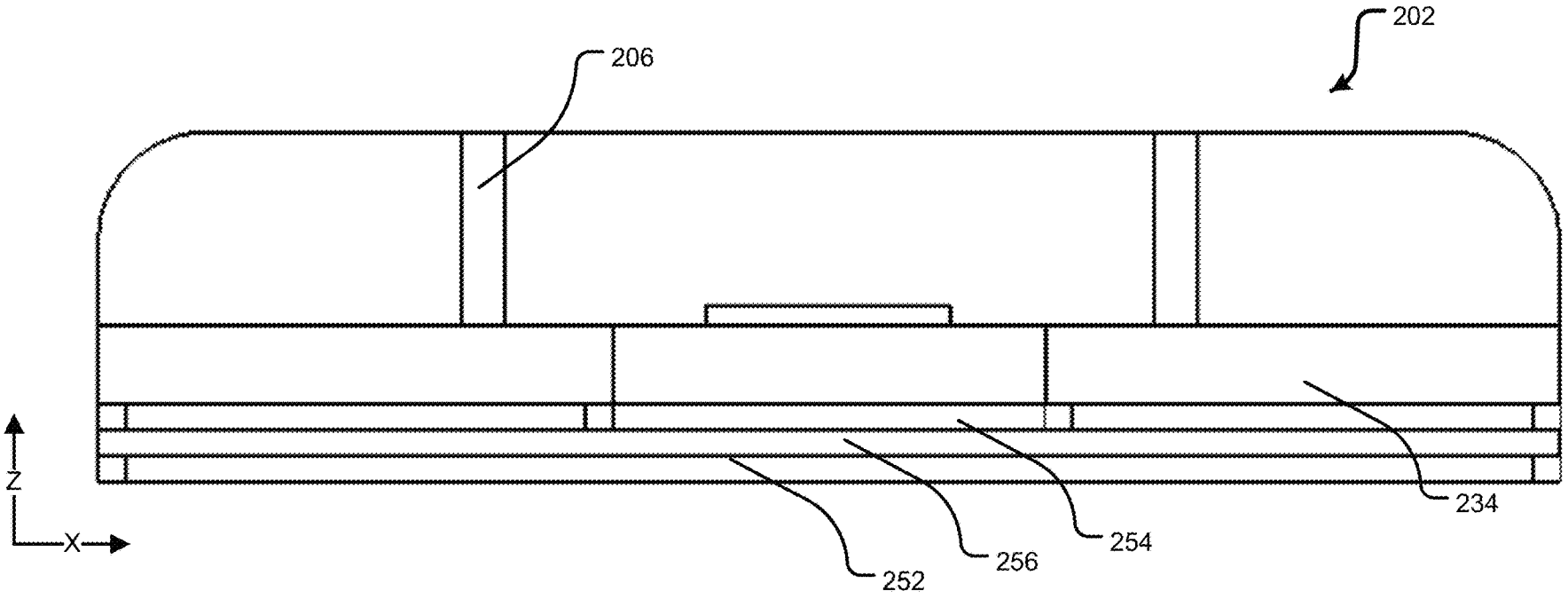
FIG. 25 illustrates a top view of the pusher paddle of FIG. 20.

FIG. 25 illustrates a top view of the pusher paddle of FIG. 20.

Figure 26:
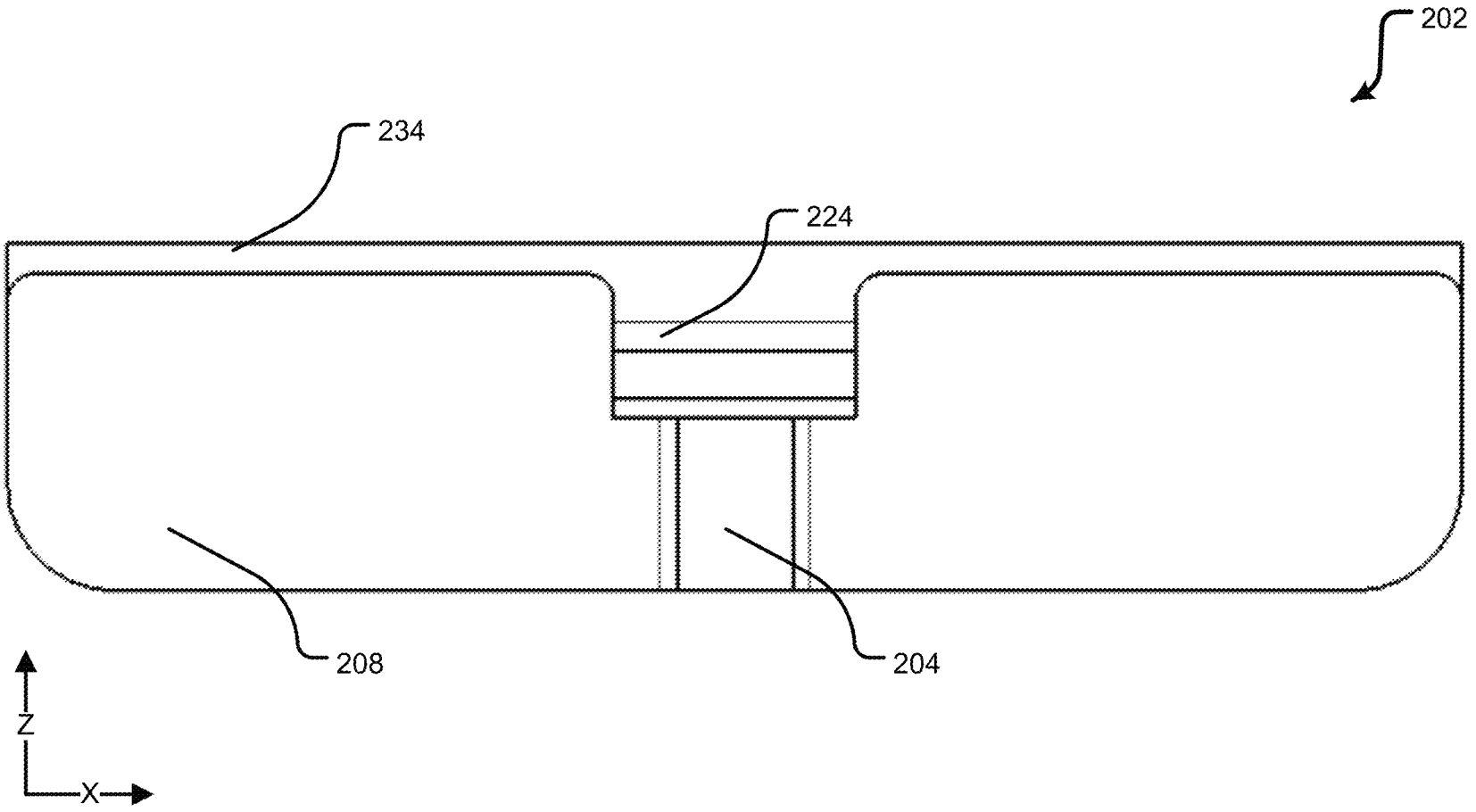
FIG. 26 illustrates a bottom view of the pusher paddle of FIG. 20.

FIG. 26 illustrates a bottom view of the pusher paddle of FIG. 20.

With reference to FIG. 9 and FIG. 13, the pusher paddle 202 may be configured to move generally horizontally along the arrow 400 (perpendicular to the y-axis and the x-axis—parallel to the z-axis as illustrated in FIG. 11) across the floor 160 of the pusher tray 102 parallel to the direction of the arrow 400. When there is no product in the pusher tray assembly 100, the pusher paddle 202 may travel to the front wall 130. As product may be inserted into the pusher tray assembly 100, the pusher paddle 202 may travel horizontally parallel to the arrow 400 towards the back wall 140.

With reference to FIGS. 20-26, the pusher paddle 202 may include an engagement mechanism 204, a front face 234, a paddle graphic holder portion 250, a front portion 252, a back portion 254, a slot 256, a finger relief portion 260 (finger slot or finger access slot), and/or the like. The pusher paddle 202 may include a material that is synthetic, plastic, bioplastic, polymer, plastic composite, and/or the like. In one aspect, the material comprises a polypropylene. In one or more aspects, the pusher paddle 202 may include a transparent and/or translucent material.

With reference to FIG. 22, the engagement mechanism 204 may extend vertically below the pusher paddle 202. The engagement mechanism 204 may be configured to control movement of the pusher paddle 202 within the pusher tray assembly 100. In particular, the engagement mechanism 204 may engage the at least one slot 164 arranged in the floor 160 of the pusher tray assembly 100. The at least one slot 164 may be a generally rectangular slot that may extend through the floor 160. Other shaped structures for the at least one slot 164 are contemplated as well.

During assembly, the engagement mechanism 204 may be inserted into the at least one slot opening 166. The at least one slot opening 166 may be a rectangular aperture having a size commensurate with the engagement mechanism 204 of the pusher paddle 202. Other shaped implementations of the at least one slot opening 166 are contemplated as well. Once the pusher paddle 202 moves from the location of the at least one slot opening 166 in the direction of arrow 400 toward the front wall 130, the engagement mechanism 204 may be held securely in the at least one slot 164. In particular, the engagement mechanism 204 may extend through the at least one slot 164 such that it may be vertically below the floor 160 and/or the upper surface 169. In one aspect, the engagement mechanism 204 may be located below the bottom wall 170 of the pusher tray assembly 100. Additionally, the pusher paddle 202 may be arranged above the floor 160, the upper surface 169, the at least one slot 164, and/or the bottom wall 170.

While the pusher paddle 202 is arranged above the at least one slot opening 166 at its most rearward position adjacent the back wall 140, the pusher paddle 202 may be inserted or removed from the floor 160. The engagement mechanism 204 is discussed in greater detail below.

As illustrated in FIG. 20, the pusher paddle 202 of the pusher tray assembly 100 may further include the paddle graphic holder portion 250. In one aspect, the paddle graphic holder portion 250 may be formed of a clear pocket adhered to the pusher paddle 202.

The paddle graphic holder portion 250 may hold an image of the product to be held by the pusher paddle 202 of the pusher tray assembly 100, such as a graphic medium. For example, the graphic medium may be a price tag, a barcode, a product description, a sign, a promotional sign, plan information, plan update information, signage, a price card, pricing signage, a QR code, and/or the like. Accordingly, when stocking personnel is placing product into pusher tray assembly 100, they may be clearly informed of the correct product for placement in the pusher tray assembly 100. Additionally, customers looking for a particular product may more clearly recognize a desired product even if that product is currently out of stock. Thus, the customer can then seek help from the retail establishment for obtaining the product from, for example, the stock room.

Additionally, the paddle graphic holder portion 250 may include a front portion 252, a back portion 254, and a slot 256. The paddle graphic holder portion 250 may be held on the front face 234 of the pusher paddle 202 as illustrated in FIG. 20. The paddle graphic holder portion 250 may include a material that is synthetic, plastic, bioplastic, polymer, plastic composite, and/or the like. In one or more aspects, the paddle graphic holder portion 250 may include a transparent and/or translucent material. In this regard, the paddle graphic holder portion 250 may be configured to hold a graphic medium inside. The paddle graphic holder portion 250 may be molded, three dimensionally printed, injection molded, machined, and/or the like.

The pusher paddle 202 may further include fin portions 206. The fin portions 206 may have a generally triangular and/or a polygonal shape. The fin portions 206 may be arranged on the back face 236 and may extend from a top surface of the pusher paddle 202 down to a bottom edge 216. The bottom edge 216 may have a large width along the x-axis and a large width across the z-axis. The large width of the bottom edge 216 providing increased stability for the pusher paddle 202 as it traverses the floor 160. More specifically, the large width of the bottom edge 216 helps to ensure that the front face 234 remains vertical as the pusher paddle 202 travels across the floor 160 in the direction of arrow 400.

As shown in FIG. 23, the pusher paddle 202 may include a bottom surface 208. The bottom surface 208 may contact the floor 160 of the pusher tray 102 and may provide stability for the pusher paddle 202. The pusher paddle 202 may further include strengthening portions 210 along a back face 236. The strengthening portions 210 may connect to the back face 236 as well as the bottom edge 216 to provide strength and support thereof.

The bottom surface 208 may further include the engagement mechanism 204. Moreover, the bottom surface 208 may connect to the engagement mechanism 204. In one aspect, the engagement mechanism 204 may be integrated into the bottom surface 208. The engagement mechanism 204 may be inserted into at least one slot opening 166 as illustrated in FIG. 16 and may be positioned below the floor 160 thereafter. As illustrated in FIG. 24, the engagement mechanism 204 may include extensions 228 that extend horizontally along the x-axis. The engagement mechanism 204 may include a portion that extends vertically below the bottom surface 208. Additionally, the engagement mechanism 204 may implement the extensions 228, which may be generally horizontal or parallel to the major surface of the floor 160. The extensions 228 may be connected to a vertical portion of the engagement mechanism 204 that may also be connected to the bottom surface 208.

The vertical portion of the engagement mechanism 204 may extend through the at least one slot 164 of the floor 160 and the extensions 228 may be arranged below the floor 160. Hence, once the engagement mechanism 204 is extended into at least one slot opening 166, the pusher paddle 202 can traverse back and forth along the arrow 400 in the pusher tray assembly 100 in a manner such that the pusher paddle 202 cannot be easily separated from the pusher tray assembly 100. In this regard, the engagement mechanism 204 being locked into and below the at least one slot 164. Although a single implementation of the engagement mechanism 204 is contemplated by the disclosure, in some aspects there may be multiple implementations of the engagement mechanism 204.

Figure 27:
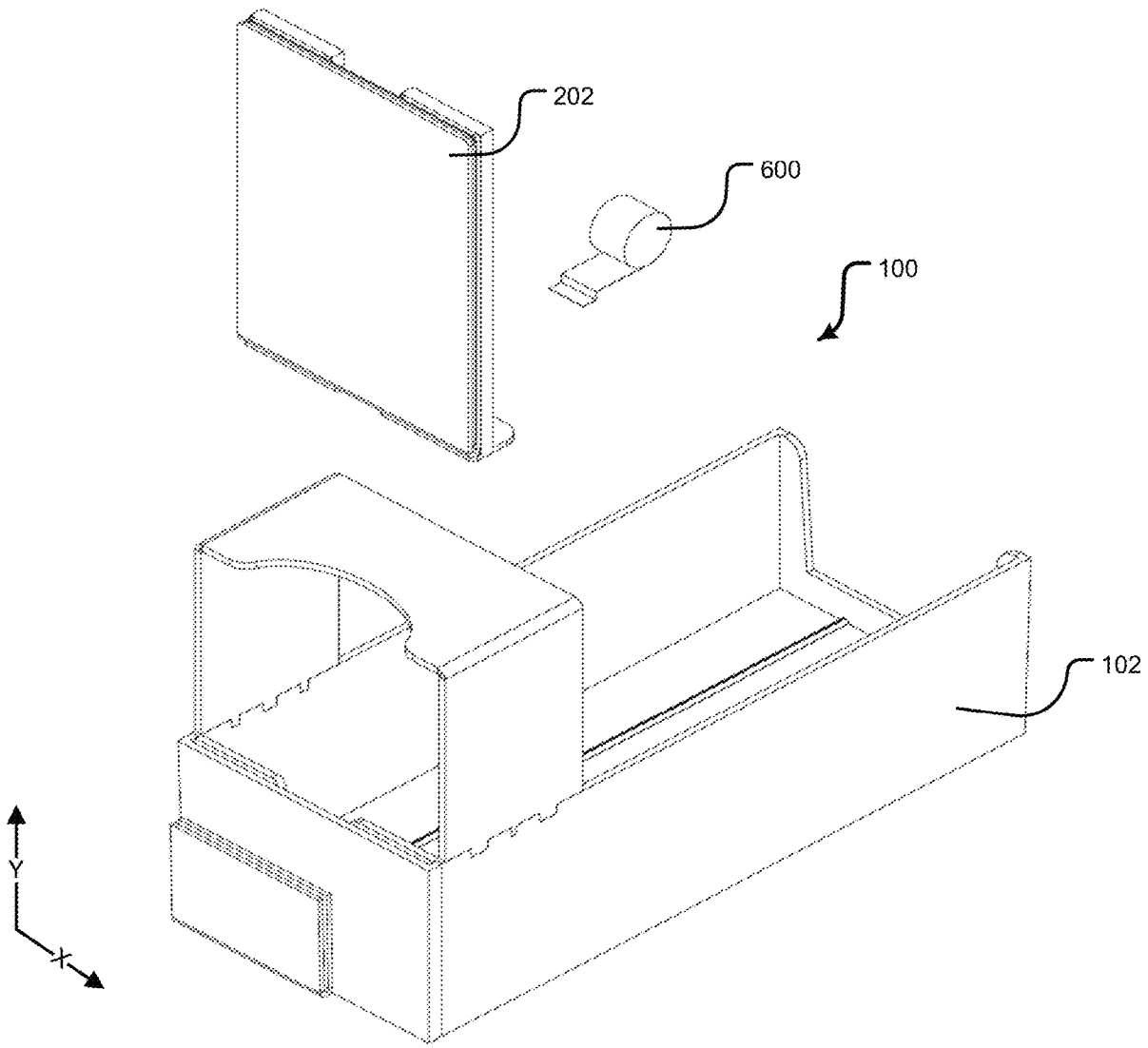
FIG. 27 illustrates a partially exploded front right perspective view of the product display pusher system according to FIG. 9.

FIG. 27 illustrates a partially exploded front right perspective view of the product display pusher system according to FIG. 9.

Figure 28:
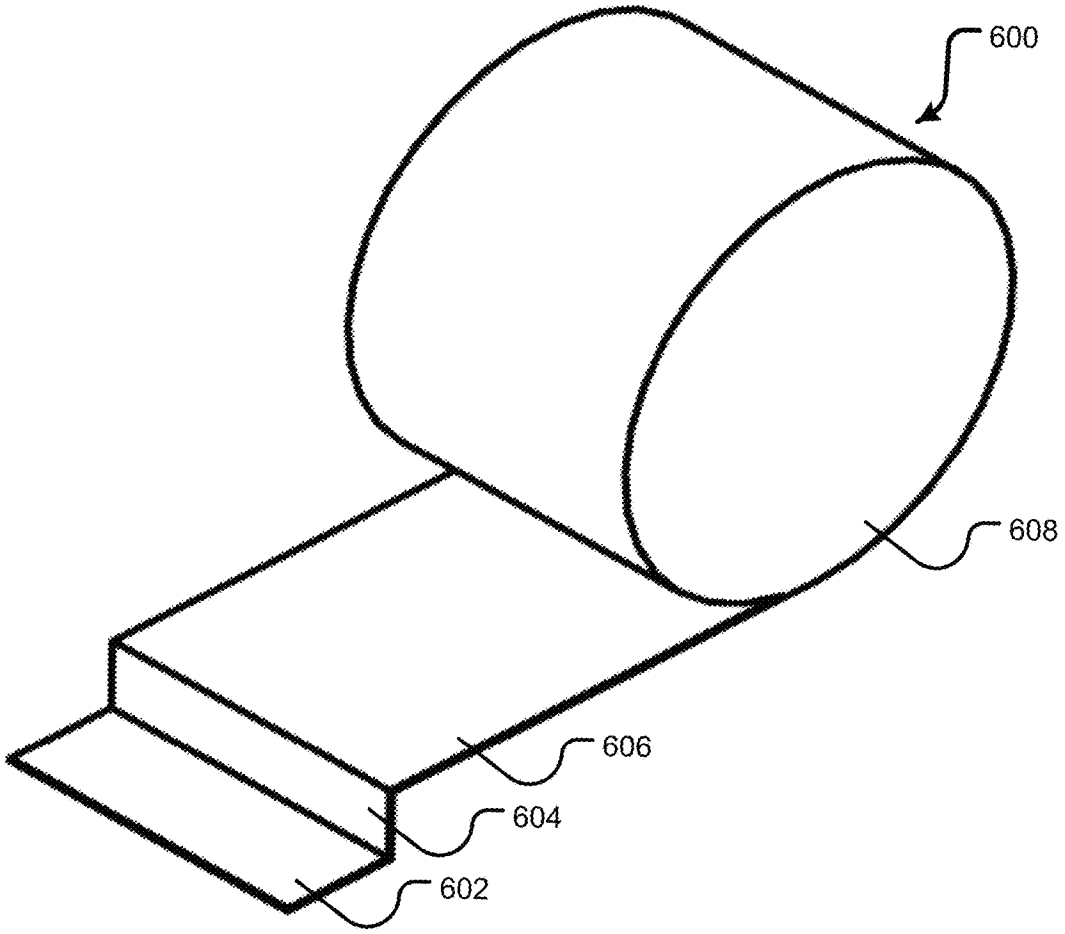
FIG. 28 illustrates a perspective view of an exemplary spring for the product display pusher system according to FIG. 9.

FIG. 28 illustrates a perspective view of an exemplary spring for the product display pusher system according to FIG. 9.

The pusher paddle 202 may be further configured with a spring 600 as illustrated in FIG. 27. The spring 600 may be a flat coiled spring. As illustrated in FIG. 28, the spring 600 may be a coiled spring having an end 602 that may be securely engaged with the pusher tray assembly 100. In one aspect, the end 602 of the spring 600 may be securely engaged to the slot 168. In one aspect, the end 602 of the spring 600 may be securely engaged to an attachment feature located in the front wall 130 and/or floor 160 adjacent the front wall 130. In one aspect, the end 602 may include a bent portion 604.

In one aspect, the spring 600 and may be a flat torsional spring. The spring 600 may be configured to coil into a cylinder 608 as illustrated in FIG. 27. As the pusher paddle 202 may be moved in the direction of arrow 400 toward the back wall 140 of the pusher tray assembly 100, the spring 600 may uncoil and provide a spring force to the pusher paddle 202 urging the pusher paddle 202 toward the front wall 130 of the pusher tray assembly 100. In one aspect, as the spring 600 uncoils a portion 606, the force exerted by the spring 600 on the pusher paddle 202 increases. This may be beneficial as the spring 600 uncoils, more product is being held by the pusher tray assembly 100 increasing the required force to move the product forward towards the front wall 130. In other words, the configuration of the spring 600 provides a variable force to address the correspondingly variable weight of the product ensuring that the product is correspondingly moved toward the front wall 130. Accordingly, product arranged between a front face 234 of the pusher paddle 202 may be urged by the pusher paddle 202 in conjunction with the spring 600 to be moved toward that the front wall 130. Other types of mechanisms are contemplated to apply a spring or elastic force to the pusher paddle 202 to urge it toward the front wall 130. With reference to FIG. 21, the pusher paddle 202 may further include a spring support 212. The spring support 212 may be attached to the back face 236 of the pusher paddle 202. The spring 600 may be positioned on the spring support 212 and the end 602 of the spring 600 may extend out a spring slot 224 arranged on the front face 234 and the back face 236 of the pusher paddle 202.

With reference to FIG. 17, the pusher tray assembly 100 may include the slot 168. The slot 168 may be configured to receive the end 602 of the spring 600. The end 602 may be inserted into the slot 168 and held by the slot 168.

With the products 302 arranged in the pusher tray assembly 100, the pusher paddle 202 may be moved in the direction of arrow 400 toward the back wall 140. This movement of the pusher paddle 202 may extend a portion 606 of the spring 600, which may be attached to an area adjacent the front wall 130, such as, the slot 168. The extension of the portion 606 of the spring 600 generates a force applied to the pusher paddle 202. This force applied to the pusher paddle 202 urges the pusher paddle 202 in the direction of arrow 400 toward the front wall 130. In this regard, if the customer takes one of the products 302 from the pusher tray assembly 100, leaving an open space in the pusher tray 102 at a location adjacent the front wall 130, the pusher paddle 202 may be urged by the spring 600 to move in the direction of arrow 400 toward the front wall 130 to advance the product 302 forwardly toward the front wall 130. Accordingly, the pusher tray assembly 100 may always have a product 302 located adjacent the front wall 130. Removing additional of the product 302 may continue the movement of the pusher paddle 202 toward the front wall 130.

In one or more aspects as described herein, the pusher tray assembly 100 may be implemented as a custom molded pusher system that holds or otherwise maintains the product 302, such as cards, Service Plan cards, and/or the like pushed towards the front end 104 of the pusher tray assembly 100 at all times. The pusher tray assembly 100 and/or the pusher tray 102 can be easily removed from the display in order to restock. For example, as further described below, stocking personnel can pull the "pusher paddle" back to add more cards to the pusher system. The pusher tray assembly 100 may include the inventory control bar 150 implemented as a front "Inventory Control Bar" that retains the product 302, such as a stack of cards, together as a customer pulls the front card—Avoiding "Spillage" of cards. Additionally, the inventory control bar 150 or Inventory Control Bar may include a finger relief to make it easier for the first card to be pulled from the pusher system with ease. The pusher tray assembly 100 may further include a front "Graphic Holder" that may be part of the front wall 130 that allows for special promotional signs, plan update information, and/or the like to be clearly shown on the front of each card pusher tray of the pusher tray assembly 100. Additionally, the pusher tray assembly 100 may include a price channel implemented as part of the outer surface structure 132 that allows for the store to place the pricing signage and/or the like on the front of each tray for easy visibility.

The following are a number of nonlimiting Examples of aspects of the disclosure.

One example includes a retail product display system configured to display product in a retail setting, the retail product display system includes: a top surface, at least one side surface, a back surface, and a bottom surface configured to form a generally rectangular box structure that includes a generally open front side; a plurality of shelf units extending across the generally open front side; a pusher tray assembly configured to hold products includes a pusher tray including a floor, a bottom surface, a front wall, at least one sidewall, and at least one back wall, where the floor is configured to hold the products thereon; at least one door configured to provide security for the product that is held within the generally open front side; a doorframe configured to hold the at least one door; where one or more of the top surface, the side surface, the back surface, and the bottom surface connect with a connection; and where the connection includes at least one of the following: a welded portion, a mechanically fastened portion, a brazed portion, a bent portion, and an adhesive connection portion.

The above-noted Example may further include any one or a combination of more than one of the following aspects. The retail product display system where the retail product display system is configured to have a lower security configuration without any structure impeding access through the generally open front side to the products. The retail product display system is configured to have a higher security configuration with structure impeding access through the generally open front side to the products; and where the higher security configuration is implemented such that the generally open front side is surrounded by the doorframe. The doorframe includes a plurality of tabs configured to securely attach the doorframe to the retail product display system. The doorframe is configured to securely hold the at least one door with a track to guide the at least one door with a lateral motion. The at least one door include one or more of roller bearings arranged at a lower edge of the at least one door. The pusher tray assembly further includes a pusher paddle having a front face and a back face; an engagement mechanism arranged on a lower side of the pusher paddle and configured to secure the pusher paddle to the floor; a channel arranged in the floor and configured to receive the engagement mechanism; a spring configured to urge the pusher paddle and the products towards the front wall; and an inventory control bar configured to at least partially cover the products, where the pusher tray includes a transparent material. The inventory control bar is configured to be attached to the at least one sidewall with connection portions. The connection portions includes dove tail structures. The inventory control bar is configured to ensure that the products remain within the pusher tray. The retail product display system includes: a locking feature arranged on and extending vertically from the bottom surface, the locking feature is configured to lock the pusher tray to a retail fixture; and the locking feature is configured to secure the pusher tray to a corresponding feature on the retail fixture. The inventory control bar is configured to allow a front one of the products to be removed and retain remaining products in the pusher tray. The retail product display system includes raised rails integrated into the floor, the raised rails are configured to directly support the products and provide reduced friction between the products and the floor. The retail product display system includes: an insertion slot associated with the channel, the insertion slot configured to receive the engagement mechanism therethrough. Colon>the front wall is configured to form a slot, the slot being an opening at an upper end of the front wall, and the slot is configured to receive a graphic medium. The channel portion is configured to form a slot; and where the slot is configured to receive a graphic medium. The paddle graphic holder portion is configured to form a slot; and where the slot is configured to receive a graphic medium.

One example includes a retail product display system configured to display product in a retail setting, the retail product display system includes: a top surface, at least one side surface, a back surface, and a bottom surface configured to form a generally rectangular box structure that includes a generally open front side; a plurality of shelf units extending across the generally open front side; a pusher tray assembly configured to hold products includes a pusher tray including a floor, a bottom surface, a front wall, at least one sidewall, and at least one back wall, where the floor is configured to hold the products thereon; at least one door configured to provide security for the product that is held within the generally open front side; a doorframe configured to hold the at least one door; where one or more of the top surface, the side surface, the back surface, and the bottom surface connect with a connection; where the connection includes at least one of the following: a welded portion, a mechanically fastened portion, a brazed portion, a bent portion, and an adhesive connection portion; and where the doorframe is configured to securely hold the doors with a track to guide the doors with a lateral motion.

The above-noted Example may further include any one or a combination of more than one of the following aspects. The retail product display system where the pusher tray assembly further includes a pusher paddle having a front face and a back face; an engagement mechanism arranged on a lower side of the pusher paddle and configured to secure the pusher paddle to the floor; a channel arranged in the floor and configured to receive the engagement mechanism; a spring configured to urge the pusher paddle and the products towards the front wall; and an inventory control bar configured to at least partially cover the products, where the pusher tray includes a transparent material. The retail product display system is configured to have a lower security configuration without any structure impeding access through the generally open front side to product. The retail product display system is configured to have a higher security configuration with structure impeding access through the generally open front side to the products; and where the higher security configuration is implemented such that the generally open front side is surrounded by the doorframe. The doorframe includes a plurality of tabs configured to securely attach the doorframe to the retail product display system. The at least one door include one or more of roller bearings arranged at a lower edge of the at least one door. The inventory control bar is configured to be attached to the at least one sidewall with connection portions. The connection portions includes dove tail structures. The inventory control bar is configured to ensure that the products remain within the pusher tray. The retail product display system includes: a locking feature arranged on and extending vertically from the bottom surface, the locking feature is configured to lock the pusher tray to a retail fixture; and the locking feature is configured to secure the pusher tray to a corresponding feature on the retail fixture. The inventory control bar is configured to allow a front one of the products to be removed and retain remaining products in the pusher tray. The retail product display system includes raised rails integrated into the floor, the raised rails are configured to directly support the products and provide reduced friction between the products and the floor. The retail product display system includes: an insertion slot associated with the channel, the insertion slot configured to receive the engagement mechanism therethrough. Colon>the front wall is configured to form a slot, the slot being an opening at an upper end of the front wall, and the slot is configured to receive a graphic medium. The channel portion is configured to form a slot; and where the slot is configured to receive a graphic medium. The paddle graphic holder portion is configured to form a slot; and where the slot is configured to receive a graphic medium.

One example includes a retail product display system configured to display product in a retail setting, the retail product display system includes: a top surface, at least one side surface, a back surface, and a bottom surface configured to form a generally rectangular box structure that includes a generally open front side; a plurality of shelf units extending across the generally open front side; a pusher tray assembly configured to hold products includes a pusher tray including a floor, a bottom surface, a front wall, at least one sidewall, and at least one back wall, where the floor is configured to hold the products thereon; at least one door configured to provide security for the product that is held within the generally open front side; a doorframe configured to hold the at least one door; where the pusher tray assembly further includes a pusher paddle having a front face and a back face and an engagement mechanism arranged on a lower side of the pusher paddle and configured to secure the pusher paddle to the floor; where one or more of the top surface, the side surface, the back surface, and the bottom surface connect with a connection; and where the connection includes at least one of the following: a welded portion, a mechanically fastened portion, a brazed portion, a bent portion, and an adhesive connection portion.

The above-noted Example may further include any one or a combination of more than one of the following aspects. The retail product display system where the pusher tray assembly further includes a channel arranged in the floor and configured to receive the engagement mechanism; a spring configured to urge the pusher paddle and the products towards the front wall; and an inventory control bar configured to at least partially cover the products, where the pusher tray includes a transparent material. The inventory control bar is configured to be attached to the at least one sidewall with connection portions. The connection portions includes dove tail structures. The inventory control bar is configured to ensure that the products remain within the pusher tray. The retail product display system includes: a locking feature arranged on and extending vertically from the bottom surface, the locking feature is configured to lock the pusher tray to a retail fixture; and the locking feature is configured to secure the pusher tray to a corresponding feature on the retail fixture. The inventory control bar is configured to allow a front one of the products to be removed and retain remaining products in the pusher tray. The retail product display system includes raised rails integrated into the floor, the raised rails are configured to directly support the products and provide reduced friction between the products and the floor. The retail product display system includes: an insertion slot associated with the channel, the insertion slot configured to receive the engagement mechanism therethrough. Colon>the front wall is configured to form a slot, the slot being an opening at an upper end of the front wall, and the slot is configured to receive a graphic medium. The channel portion is configured to form a slot; and where the slot is configured to receive a graphic medium. The paddle graphic holder portion is configured to form a slot; and where the slot is configured to receive a graphic medium. The retail product display system is configured to have a lower security configuration without any structure impeding access through the generally open front side to product. The retail product display system is configured to have a higher security configuration with structure impeding access through the generally open front side to the products; and where the higher security configuration is implemented such that the generally open front side is surrounded by the doorframe. The doorframe includes a plurality of tabs configured to securely attach the doorframe to the retail product display system. The doorframe is configured to securely hold the at least one door with a track to guide the at least one door with a lateral motion.

Relative terms such as "below" or "above" or "upper" or "lower" or "top" or "bottom" may be used herein to describe a relationship of one element, layer or region to another element, layer or region as illustrated in the figures. It will be understood that these terms are intended to encompass different orientations of the device in addition to the orientation depicted in the figures.

The many features and advantages of the disclosure are apparent from the detailed specification, and, thus, it is intended by the appended claims to cover all such features and advantages of the disclosure, which fall within the true spirit, and scope of the disclosure. Further, since numerous modifications and variations will readily occur to those skilled in the art, it is not desired to limit the disclosure to the exact construction and operation illustrated and described, and, accordingly, all suitable modifications and equivalents may be resorted to that fall within the scope of the disclosure.

What is claimed is:

1. A retail product display system configured to display one or more products in a retail setting, the retail product display system comprising:

a top surface, at least one side surface, a back surface, and a bottom surface configured to form a generally rectangular box structure that includes (i) a generally open front side and (ii) a plurality of shelf units extending across the generally open front side in a longitudinal direction;

a pusher tray assembly configured to hold the one or more products comprising a pusher tray including a floor, a bottom surface, a front wall, at least one sidewall, and at least one back wall, wherein the floor is configured to hold the one or more products thereon;

an engagement mechanism configured to (i) secure a pusher paddle to the floor and (ii) control movement of the pusher paddle within the pusher tray assembly along a direction perpendicular to the longitudinal direction;

an insertion slot (i) arranged in the floor and (ii) configured to receive the engagement mechanism therethrough;

at least one door configured to provide security for the one or more held products;

a doorframe in relation to which the at least one door is configured to move, wherein the doorframe is removably coupled to the retail product display system, wherein the retail product display system is configured to have a lower security configuration via removal of the doorframe;

wherein one or more of the top surface, the side surface, the back surface, and the bottom surface connect with a connection; and wherein the connection comprises at least one of the following: a welded portion, a mechanically fastened portion, a brazed portion, a bent portion, and an adhesive connection portion.

2. The retail product display system according to claim 1, wherein the generally open front side is surrounded by the doorframe.

3. The retail product display system according to claim 1, wherein the doorframe includes a plurality of tabs configured to securely attach the doorframe to the retail product display system.

4. The retail product display system according to claim 1, wherein the doorframe is configured to securely hold the at least one door with a track to guide the at least one door with a lateral motion.

5. The retail product display system according to claim 4, wherein the at least one door includes one or more of roller bearings arranged at a lower edge of the at least one door.

6. The retail product display system according to claim 1, wherein the pusher tray assembly further comprises:

the pusher paddle having a front face and a back face;

the engagement mechanism arranged on a lower side of the pusher paddle;

a spring configured to urge the pusher paddle and the one or more products towards the front wall; and an inventory control bar configured to at least partially cover the one or more products, wherein the pusher tray comprises a transparent material.

7. The retail product display system according to claim 6 wherein the inventory control bar is configured to be attached to the at least one sidewall with connection portions.

8. The retail product display system according to claim 7 wherein the connection portions comprise dove tail structures.

9. The retail product display system according to claim 6 wherein the inventory control bar is configured to ensure that the one or more products remain within the pusher tray.

10. The retail product display system according to claim 6 further comprising:

a locking feature arranged on and extending vertically from the bottom surface, the locking feature is configured to lock the pusher tray to a retail fixture; and the locking feature is configured to secure the pusher tray to a corresponding feature on the retail fixture.

11. The retail product display system according to claim 6 wherein the inventory control bar is configured to allow a front one of the one or more products to be removed and retain one or more remaining products in the pusher tray.

12. The retail product display system according to claim 6 further comprising: raised rails integrated into the floor, the raised rails are configured to directly support the one or more products and provide reduced friction between the one or more products and the floor.

13. The retail product display system according to claim 6 wherein:

the front wall is configured to form a slot;

the slot being an opening at an upper end of the front wall; and the slot is configured to receive a graphic medium.

14. The retail product display system according to claim 6 further comprising a channel portion attached to the front wall, wherein the channel portion is configured to form a slot; and wherein the slot is configured to receive a graphic medium.

15. The retail product display system according to claim 6 further comprising a paddle graphic holder portion attached to the pusher paddle, wherein the paddle graphic holder portion is configured to form a slot; and wherein the slot is configured to receive a graphic medium.

16. A retail product display system configured to display one or more products in a retail setting, the retail product display system comprising:

a top surface, at least one side surface, a back surface, and a bottom surface configured to form a generally rectangular box structure that includes (i) a generally open front side and (ii) a plurality of shelf units extending across the generally open front side in a longitudinal direction;

a pusher tray assembly configured to hold the one or more products comprising a pusher tray including a floor, a bottom surface, a front wall, at least one sidewall, and at least one back wall, wherein the floor is configured to hold the one or more products thereon;

an engagement mechanism configured to (i) secure a pusher paddle to the floor and (ii) control movement of the pusher paddle within the pusher tray assembly along a direction perpendicular to the longitudinal direction;

an insertion slot (i) arranged in the floor and (ii) configured to receive the engagement mechanism therethrough;

at least one door configured to provide security for the one or more held products;

a doorframe in relation to which the at least one door is configured to move, wherein the doorframe is removably coupled to the retail product display system, and wherein the retail product display system is configured to have a lower security configuration via removal of the doorframe;

wherein one or more of the top surface, the side surface, the back surface, and the bottom surface connect with a connection;

wherein the connection comprises at least one of the following: a welded portion, a mechanically fastened portion, a brazed portion, a bent portion, and an adhesive connection portion; and wherein the doorframe is configured to securely hold the at least one door with a track to guide the at least one door with a lateral motion.

17. The retail product display system according to claim 16, wherein the pusher tray assembly further comprises:

the pusher paddle having a front face and a back face;

the engagement mechanism arranged on a lower side of the pusher paddle;

a spring configured to urge the pusher paddle and the one or more products towards the front wall; and an inventory control bar configured to at least partially cover the one or more products, wherein the pusher tray comprises a transparent material.

18. The retail product display system according to claim 17, wherein the generally open front side is surrounded by the doorframe.

19. The retail product display system according to claim 17, wherein the doorframe includes a plurality of tabs configured to securely attach the doorframe to the retail product display system.

20. The retail product display system according to claim 17, wherein the at least one door includes one or more of roller bearings arranged at a lower edge of the at least one door.

21. The retail product display system according to claim 17 wherein the inventory control bar is configured to be attached to the at least one sidewall with connection portions.

22. The retail product display system according to claim 21 wherein the connection portions comprise dove tail structures.

23. The retail product display system according to claim 17 wherein the inventory control bar is configured to ensure that the one or more products remain within the pusher tray.

24. The retail product display system according to claim 17 further comprising:

a locking feature arranged on and extending vertically from the bottom surface, the locking feature is configured to lock the pusher tray to a retail fixture; and the locking feature is configured to secure the pusher tray to a corresponding feature on the retail fixture.

25. The retail product display system according to claim 17 wherein the inventory control bar is configured to allow a front one of the one or more products to be removed and retain one or more remaining products in the pusher tray.

26. The retail product display system according to claim 17 further comprising:

raised rails integrated into the floor, the raised rails are configured to directly support the one or more products and provide reduced friction between the one or more products and the floor.

27. The retail product display system according to claim 17 wherein:

the front wall is configured to form a slot;

the slot being an opening at an upper end of the front wall; and the slot is configured to receive a graphic medium.

28. The retail product display system according to claim 17 further comprising a channel portion attached to the front wall, wherein the channel portion is configured to form a slot; and wherein the slot is configured to receive a graphic medium.

29. The retail product display system according to claim 17 further comprising a paddle graphic holder portion attached to the pusher paddle, wherein the paddle graphic holder portion is configured to form a slot; and wherein the slot is configured to receive a graphic medium.

* * * * *